US009806419B2

(12) United States Patent
Uno et al.

(10) Patent No.: US 9,806,419 B2
(45) Date of Patent: Oct. 31, 2017

(54) ARRAY ANTENNA DEVICE

(71) Applicant: Panasonic Intellectual Property Management Co., Ltd., Chuo-Ki, Osaka-shi (JP)

(72) Inventors: Hiroyuki Uno, Ishikawa (JP); Yuichi Kashino, Ishikawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 177 days.

(21) Appl. No.: 14/361,687

(22) PCT Filed: Aug. 23, 2013

(86) PCT No.: PCT/JP2013/004996
§ 371 (c)(1),
(2) Date: May 29, 2014

(87) PCT Pub. No.: WO2014/045519
PCT Pub. Date: Mar. 27, 2014

(65) Prior Publication Data

US 2014/0333502 A1 Nov. 13, 2014

(30) Foreign Application Priority Data

Sep. 20, 2012 (JP) ..... 2012-207380

(51) Int. Cl.
*H01Q 21/00* (2006.01)
*H01Q 7/00* (2006.01)
(Continued)

(52) U.S. Cl.
CPC ..... *H01Q 7/00* (2013.01); *H01Q 21/0018* (2013.01); *H01Q 21/0075* (2013.01); *H01Q 21/08* (2013.01); *H01Q 1/38* (2013.01)

(58) Field of Classification Search
CPC .... H01Q 9/0457; H01Q 7/00; H01Q 21/0075; H01Q 21/0018; H01Q 21/08
(Continued)

(56) References Cited

U.S. PATENT DOCUMENTS 4,475,107 A 10/1984 Makimoto et al.
5,594,455 A 1/1997 Hori et al.
(Continued)

FOREIGN PATENT DOCUMENTS

CN 1116779 A 2/1996
CN 1941502 A 4/2007
(Continued)

OTHER PUBLICATIONS

Hirose et al. "Fundamental Study on Novel Loop-Line Antennas Radiating a Circularly Polarized Wave" IEEE Antennas and Wireless Propag. Letters, vol. 11, May 8, 2012, p. 476-479.*
(Continued)

*Primary Examiner* — Jessica Han
*Assistant Examiner* — Hai Tran
(74) *Attorney, Agent, or Firm* — Seed Intellectual Property Law Group LLP

(57) ABSTRACT

An array antenna device includes a substrate, a strip conductor formed on one surface of the substrate, plural loop elements formed on the one surface of the substrate, and a conductor plate formed on the other surface of the substrate. Each of the loop elements has a circumferential length that is approximately equal to one wavelength of a radiated radio wave, and is disposed at such a position as to be coupled with the strip conductor electromagnetically, and the loop elements are arranged alongside the strip conductor at distances that are equal to the one wavelength.

10 Claims, 24 Drawing Sheets

(51) Int. Cl.
*H01Q 21/08* (2006.01)
*H01Q 1/38* (2006.01)

(58) Field of Classification Search
USPC ..... 343/844, 866, 811, 824
See application file for complete search history.

(56) References Cited

U.S. PATENT DOCUMENTS

| | | | | |
|---|---|---|---|---|
| 6,188,360 | B1 | 2/2001 | Kato et al. | |
| 6,424,298 | B1 * | 7/2002 | Nishikawa | H01Q 21/0037 343/700 MS |
| 7,719,083 | B2 | 5/2010 | Chang | |
| 2008/0258964 | A1 | 10/2008 | Schoeberl et al. | |
| 2009/0015496 | A1 * | 1/2009 | Liu | H01Q 9/0457 343/742 |
| 2010/0026584 | A1 * | 2/2010 | Nakabayashi | H01Q 21/065 343/700 MS |
| 2011/0128187 | A1 | 6/2011 | Ju et al. | |
| 2012/0229364 | A1 | 9/2012 | Nakabayashi et al. | |

FOREIGN PATENT DOCUMENTS

| | | | |
|---|---|---|---|
| CN | 1941504 | A | 4/2007 |
| CN | 101076741 | A | 11/2007 |
| CN | 102683858 | A | 9/2012 |
| JP | 58-125901 | A | 7/1983 |
| JP | 63-211804 | A | 9/1988 |
| JP | 2000-082916 | A | 3/2000 |
| JP | 2001-044752 | A | 2/2001 |
| JP | 2011-239258 | A | 11/2011 |

OTHER PUBLICATIONS

Li et al. "Investigation of Circularly Polarized Loop Antennas With a Parasitic Element for Bandwidth Enhancement" IEEE Antennas and Wireless Propag. Letters, vol. 53, No. 12, Dec. 2005.*

Mao et al. ("Characterization and Modeling of Left-Handed Microstrip Lines With Application to Loop Antennas" IEEE Trans. on Antennas and Propag; vol. 54, No. 4, Apr. 2006).*

Nakano et al. "Circularly Polarized Microstrip-Line Antennas Composed of Closed-Loop Radiation Cells" Published in: 2011 IEEE International Symposium on Antennas and Propagation (APSURSI), Aug. 30, 2011.*

Hirose et al., "Circularly Polarized Loop-Line Antennas," The Transaction of the Institute of Engineers, Information and Communication Engineers B, J85-B(9), Sep. 2002, 37pages.

International Search Report dated Nov. 19, 2013, for corresponding International Application No. PCT/JP2013/004996, 4 pages.

* cited by examiner (A)

FIG. 17

| LOOP ELEMENT | 151a | 151b | 151c | 151d | 151e | 131 |
|---|---|---|---|---|---|---|
| LOOP ELEMENT RADIATION POWER RATIO | 1 | 1 | 1 | 1 | 1 | 1 |
| RADIATION-POWER-TO-INPUT-POWER RATIO OF EACH LOOP ELEMENT (%) | 16. 2 | 19. 5 | 24. 6 | 33. 0 | 49. 7 | 100 |

(A)

| LOOP ELEMENT | 161a | 161b | 161c | 161d | 161e | 131 |
|---|---|---|---|---|---|---|
| LOOP ELEMENT RADIATION POWER RATIO | 0. 36 | 0. 64 | 1 | 1 | 0. 64 | 0. 36 |
| RADIATION-POWER-TO-INPUT-POWER RATIO OF EACH LOOP ELEMENT (%) | 8. 7 | 17. 2 | 32. 9 | 49. 6 | 63. 7 | 100 |

(B)

(A)

(B)

(A)

(B)

ARRAY ANTENNA DEVICE

TECHNICAL FIELD

The present disclosure relates to an array antenna device which radiates radio waves.

BACKGROUND ART

Patch array antennas are among conventional array antenna devices having a microstrip structure which are used for wireless communication or wireless positioning. FIG. 19(A) is a plan view showing the configuration of a conventional patch array antenna in which four patch elements 502*a*, 502*b*, 502*c*, and 502*d* and a feeding circuit are arranged on one surface of a dielectric substrate 501. FIG. 19(B) is a sectional view of the dielectric substrate 501.

In the patch array antenna shown in FIGS. 19(A) and 19(B), the patch elements 502*a*, 502*b*, 502*c*, and 502*d* are arranged as radiation elements on the one surface of the dielectric substrate 501 and a ground conductor 503 is formed on the other surface of the dielectric substrate 501. The patch elements 502*a*, 502*b*, 502*c*, and 502*d* are fed with power via a branching circuit 504 which consists of microstrip lines. Being thin in structure, the patch array antenna shown in FIGS. 19(A) and 19(B) can realize a high-gain radiation characteristic.

The loop-line antenna described in Non-patent document 1 is known as a conventional array antenna device. FIG. 20 is a perspective view showing the configuration of a loop-line array antenna as a conventional array antenna device. Where a microstrip line 602 is formed on a dielectric substrate 601, the loop-line array antenna shown in FIG. 20 includes radiation cells 603*a*, 603*b*, 603*c*, 603*d*, 603*e*, 603*f*, 603*g*, and 603*h* as loop-shaped radiation elements formed at regular distances.

The circumferential length of each of the radiation cells 603*a*, 603*b*, 603*c*, 603*d*, 603*e*, 603*f*, 603*g*, and 603*h* is approximately equal to one wavelength of radiated radio waves, and the distance between adjoining radiation cells is also approximately equal to one wavelength of radiated radio waves. Being simple in the feeding structure, the loop-line array antenna shown in FIG. 20 can be reduced in the number of radiation cells and radiate good circularly polarized waves.

PRIOR ART DOCUMENTS

Non-Patent Documents

Non-patent document 1: The Transactions of the Institute of Electronics, Information and Communication Engineers B, Vol. J85-B, No. 9, September 2002.

SUMMARY OF THE INVENTION

Problems to be Solved by the Invention

The present inventors studied array antenna devices which radiate radio waves. However, in the patch array antenna shown in FIG. 19(A), the branching circuit for feeding power to the patch elements is necessary and hence the feeding circuit itself is complex. This results in a problem that the array antenna device requires a wide mounting area and is large in size.

On the other hand, in the array antenna device of Non-patent document 1, in terms of structure, it is difficult to control the radiation amount (e.g., radio wave signal amplitude) of each radiation element in a wide range. It is therefore difficult to suppress sidelobes, with respect to a main beam, of radio waves radiated from the entire array antenna device.

An object of the present disclosure is to provide, to solve the above problems in the art, an array antenna device which suppresses sidelobes with respect to a main beam and thereby realizes high-gain radiation with a simple configuration.

Means for Solving the Problems

This disclosure comprises a substrate; a strip conductor formed on one surface of the substrate; plural loop elements formed on the one surface of the substrate; and a conductor plate formed on the other surface of the substrate, wherein each of the loop elements has a circumferential length that is approximately equal to one wavelength of a radiated radio wave, and is disposed at such a position as to be coupled with the strip conductor electromagnetically, and the loop elements are arranged alongside the strip conductor at distances that are equal to the one wavelength.

Advantages of the Invention

This disclosure makes it possible to suppress sidelobes with respect to a main beam and thereby realize high-gain radiation.

BRIEF DESCRIPTION OF THE DRAWINGS

FIG. 1(A) is a perspective view showing an appearance of the planar array antenna, FIG. 1(B) is a plan view of the planar array antenna, and FIG. 1(C) is a sectional view of the planar array antenna.

FIG. 3(A) shows a radiation pattern in the X-Z plane in FIG. 1, and FIG. 3(B) shows a radiation pattern in the Y-Z plane in FIG. 1.

FIG. 17(A) is a table showing a radiation power ratio and radiation-power-to-input-power ratios in percentage of the respective loop elements of the planar array antenna 150 shown in FIG. 16(A), and FIG. 17(B) is a table showing a radiation power ratio and radiation-power-to-input-power ratios in percentage of the respective loop elements of the planar array antenna 160 shown in FIG. 16(B).

MODES FOR CARRYING OUT THE INVENTION

Background of Array Antenna Device of Disclosure

Before the description of array antenna devices according to embodiments of this disclosure, the background of the conception of the array antenna devices of the disclosure will be described with reference to the drawings. For example, the microstrip array antenna disclosed in the following Referential Patent document 1 is known as a conventional array antenna device capable of controlling the signal amplitude of radiated radio waves.

(Referential Patent document 1) JP-A-2001-44752

Figure 21:
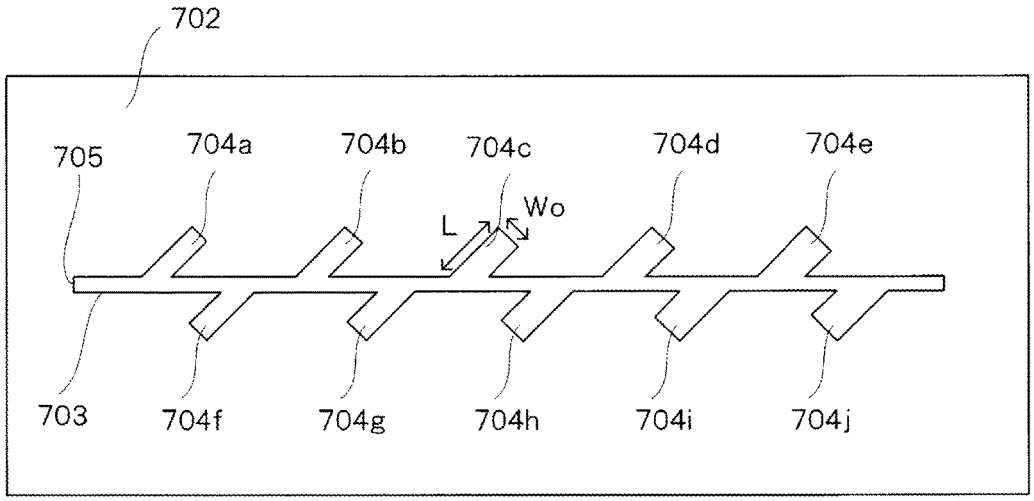
FIG. 21(A) is a plan view showing the configuration of a microstrip array antenna as a conventional array antenna device.
FIG. 21(B) is a sectional view of a dielectric substrate
Figure 21:
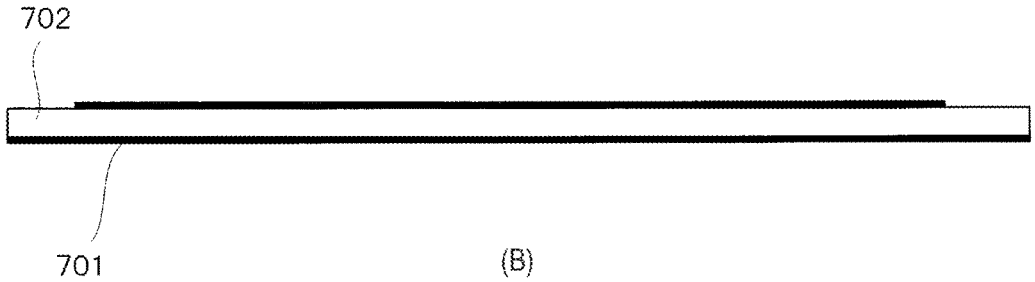

FIG. 21(A) is a plan view showing the configuration of a microstrip array antenna as a conventional array antenna device. FIG. 21(B) is a sectional view of a dielectric substrate 702.

In the microstrip array antenna shown in FIGS. 21(A) and 21(B), a feeding strip line 703 and 10 radiation antenna elements 704*a*, 704*b*, 704*c*, 704*d*, 704*e*, 704*f*, 704*g*, 704*h*, 704*i*, and 704*j* are formed on one surface of the dielectric substrate 702 and a ground conductor layer 701 is formed on the other surface of the dielectric substrate 702. The 10 radiation antenna elements 704*a*, 704*b*, 704*c*, 704*d*, 704*e*, 704*f*, 704*g*, 704*h*, 704*i*, and 704*j* project from the feeding strip line 703 which extends straightly.

Among the 10 radiation antenna elements, the radiation antenna elements 704*a*, 704*b*, 704*c*, 704*d*, and 704*e* which are provided on one side of the feeding strip line 703 are arranged in such a manner that adjoining radiation antenna elements have a distance that is approximately equal to one wavelength of radiated radio waves and are inclined so as to form about 45° with the feeding strip line 703. The length L of each of the radiation antenna elements 704*a*, 704*b*, 704*c*, 704*d*, and 704*e* is approximately equal to a half wavelength.

Likewise, among the 10 radiation antenna elements, the radiation antenna elements 704*f*, 704*g*, 704*h*, 704*i*, and 704*j* which are provided on the other side of the feeding strip line 703 are formed parallel with the radiation antenna elements 704*a*, 704*b*, 704*c*, 704*d*, and 704*e* and are inclined so as to form about −135° with the feeding strip line 703. The radiation antenna elements 704*f*, 704*g*, 704*h*, 704*i*, and 704*j* are arranged so as to be deviated from the radiation antenna elements 704*a*, 704*b*, 704*c*, 704*d*, and 704*e* by a half wavelength, respectively.

The microstrip array antenna shown in FIGS. 21(A) and 21(B) radiates radio waves as power that is input to an input end 705 of the feeding strip line 703 is coupled with the radiation antenna elements 704*a*, 704*f*, 704*b*, 704*g*, . . . , 704*e*, and 704*j* in this order. That is, the microstrip array antenna radiates 45°-polarized waves. In the microstrip array antenna, the radiation amount of each radiation antenna element can be adjusted by changing the lateral width Wo of the radiation antenna elements 704*a*, 704*b*, 704*c*, 704*d*, 704*e*, 704*f*, 704*g*, 704*h*, 704*i*, and 704*j*.

However, in the microstrip array antenna disclosed in the Referential Patent document 1, to increase the radiation amount of each radiation antenna element, it is necessary to increase the lateral width Wo of the radiation antenna elements. However, to suppress disorder of the radiation characteristic in the case where a high-frequency signal (e.g., millimeter waves) is radiated, it is necessary to set the lateral width Wo smaller than or equal to a prescribed value.

The radiation amount of one radiation antenna element is at most about 50% of input power. To design an array antenna device which radiates a high-frequency signal (e.g., millimeter waves), it is necessary to form many radiation antenna elements, which means a problem that the structure of the entire array antenna device becomes complicated.

Furthermore, since it is necessary to control the excitation distribution with the radiation amount of each radiation antenna element set smaller than about 50%. This results in a problem that the control range of the signal amplitude of radiated radio waves is restricted. The microstrip array antenna disclosed in the Referential Patent document 1 is also associated with a problem that it is difficult to radiate polarized waves that are polarized in the direction of the feeding strip line 703 or circularly polarized waves, that is, the degree of freedom of the polarization mode of radiated radio waves is low.

DESCRIPTION OF EMBODIMENTS

Planar array antennas as array antenna devices according to embodiments of this disclosure will be hereinafter described with reference to the drawings. The planar array antenna according to each embodiment is used for, for example, wireless communication or wireless positioning and has a microstrip line structure.

Embodiment 1

Figure 1:
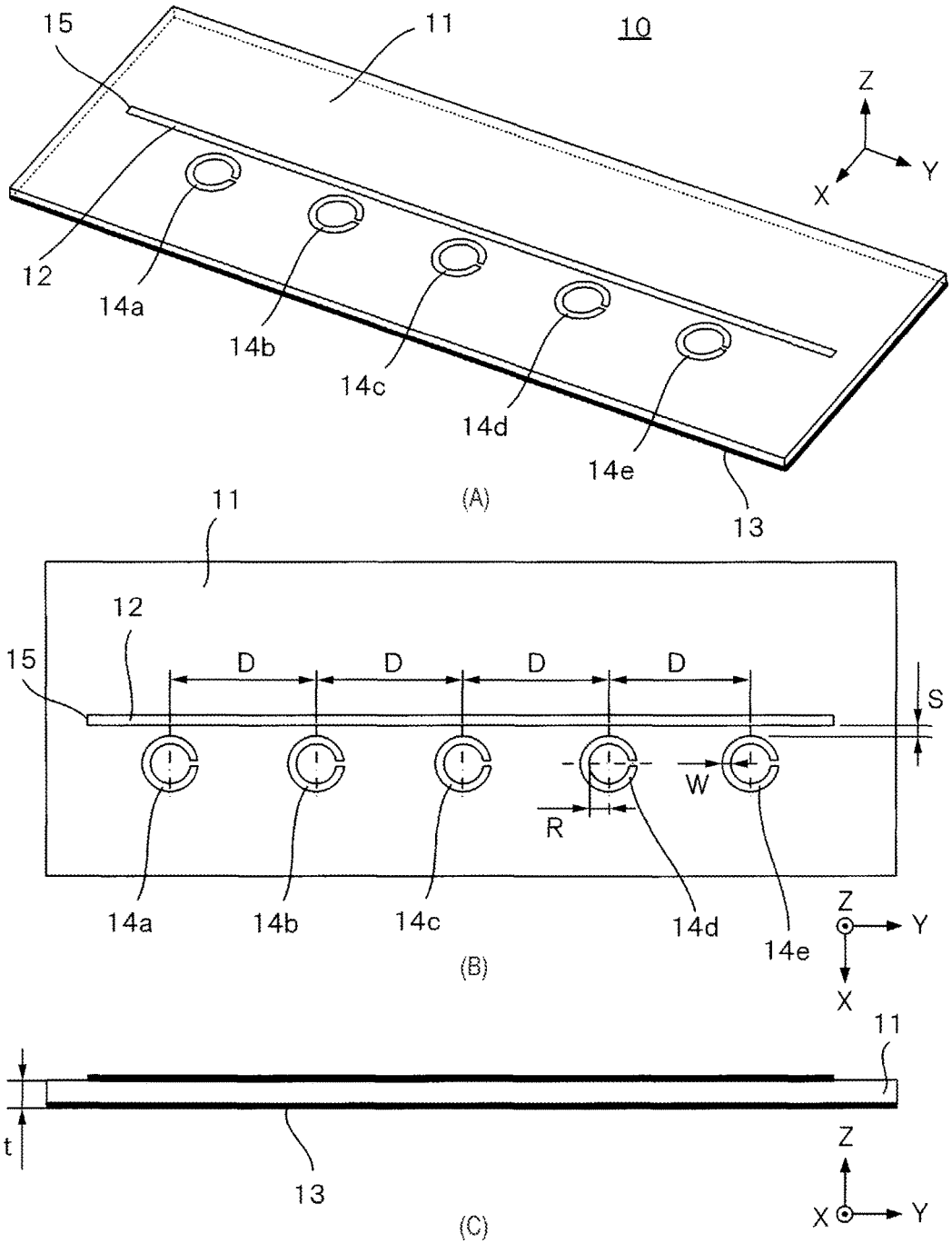
FIGS. 1(A), 1(B), and 1(C) are perspective views showing the configuration of a planar array antenna according to a first embodiment.

FIGS. 1(A), 1(B), and 1(C) are perspective views showing the configuration of a planar array antenna 10 according to a first embodiment. FIG. 1(A) is a perspective view showing an appearance of the planar array antenna 10. FIG. 1(B) is a plan view of the planar array antenna 10. FIG. 1(C) is a sectional view of the planar array antenna 10. In FIGS. 1(A), 1(B), and 1(C), the Y direction, the X direction, and the Z direction are defined as the longitudinal direction, the width direction, and the thickness direction of the planar array antenna 10, respectively.

The planar array antenna 10 includes a dielectric substrate 11, a strip conductor 12 formed on one surface of the dielectric substrate 11, plural loop elements 14*a*-14*e* formed on the one surface of the dielectric substrate 11, and a conductor plate 13 formed on the other surface of the dielectric substrate 11.

For example, the dielectric substrate 11 as a substrate is a double-sided copper-clad substrate having a thickness t and relative permittivity $\in_r$. For example, the strip conductor 12 is formed on the one surface of the dielectric substrate 11 in the form of a copper foil pattern. For example, the conductor plate 13 is formed on the other surface of the dielectric substrate 11 in the form of a copper foil pattern. In the planar array antenna 10 shown in FIG. 1(A), the strip conductor 12 and the conductor plate 13 constitute a microstrip line.

The plural loop elements 14*a*, 14*b*, 14*c*, 14*d*, and 14*e*, which are formed on the same surface of the dielectric substrate 11 as the strip conductor 12 is formed, are circular conductors having a radius R and an element width W. The loop elements 14*a*, 14*b*, 14*c*, 14*d*, and 14*e* are arranged in such a manner that adjoining ones have a loop element distance D.

Each of the loop elements 14*a*, 14*b*, 14*c*, 14*d*, and 14*e* has such an open loop structure in which part of a circular shape is cut away and the circumferential length is approximately equal to one wavelength of radiated radio waves. In the planar array antenna 10 shown in FIG. 1(A), each of the loop elements 14*a*, 14*b*, 14*c*, 14*d*, and 14*e* is spaced from the strip conductor 12 by a prescribed distance S, whereby the strip conductor 12 is electromagnetically coupled with the loop elements 14*a*, 14*b*, 14*c*, 14*d*, and 14*e* (see FIG. 1(B)).

Therefore, power that is input to an input end 15 of the strip conductor 12 is supplied to the loop elements 14*a*, 14*b*, 14*c*, 14*d*, and 14*e* in this order through the electromagnetic coupling between the strip conductor 12 and the loop elements 14*a*, 14*b*, 14*c*, 14*d*, and 14*e*. That is, the planar array antenna 10 operates as an array antenna device in which the loop elements 14*a*, 14*b*, 14*c*, 14*d*, and 14*e* serve as individual radiation elements.

Each of the loop elements 14*a*, 14*b*, 14*c*, 14*d*, and 14*e* has a high directional gain because the circumferential length of each of the loop elements 14*a*, 14*b*, 14*c*, 14*d*, and 14*e* is approximately equal to one wavelength of radiated radio waves. Therefore, the planar array antenna 10 provides a high gain though it has a simple configuration that a small number of loop elements are arranged.

Furthermore, when the loop element distance D is set approximately equal to $\lambda_g$ (an effective wavelength of a signal that travels through the strip conductor 12), the loop elements 14*a*, 14*b*, 14*c*, 14*d*, and 14*e* are excited at the same phase, whereby beam radiation directivity having a maximum gain in the +Z direction.

Figure 2:
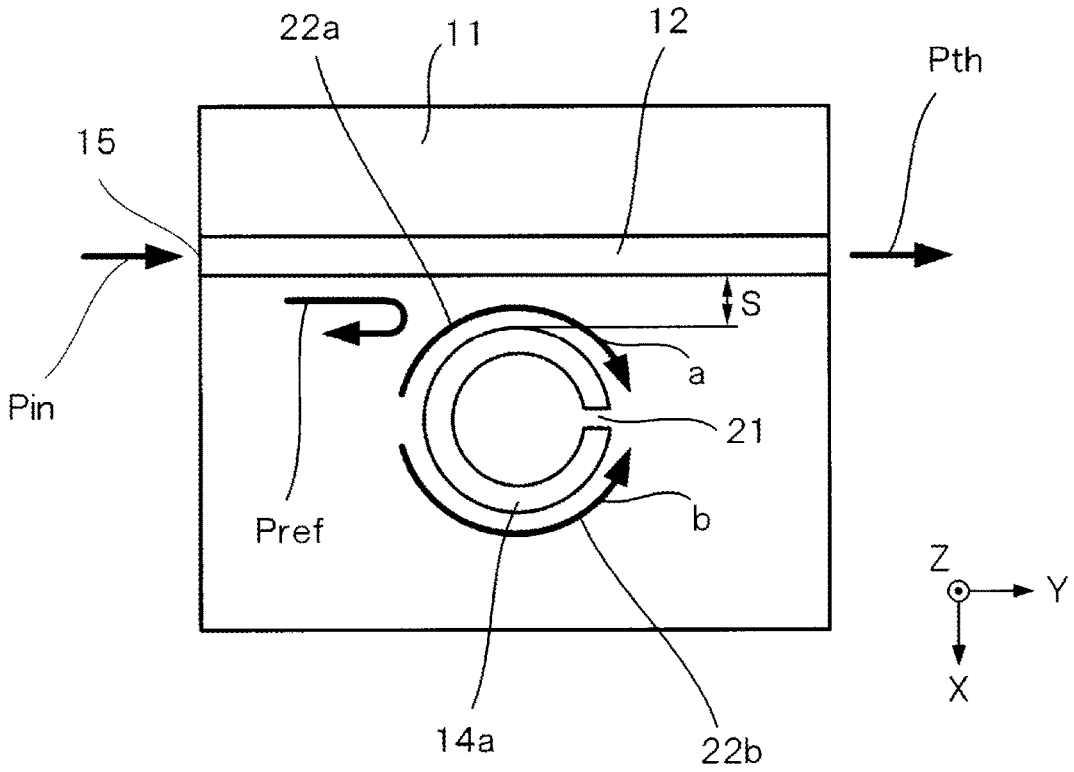
FIG. 2 illustrates the principle of radiation of radio waves from a loop element.

Next, with reference to FIG. 2, a description will be made of the principle of radiation of radio waves from each of the loop elements 14*a*, 14*b*, 14*c*, 14*d*, and 14*e* of the planar array antenna 10 according to the embodiment. FIG. 2 illustrates the principle of radiation of radio waves from the loop element 14*a*. Although the description with reference to FIG. 2 will be made using an example loop element 14*a* among the five loop elements, the principle of radiation of radio waves from each of the other loop elements is the same as described below.

Part of power Pin that is input from the input terminal 15 is radiated from the loop element 14*a* through the electromagnetic coupling between the strip conductor 12 and the loop element 14*a*. Since an opening 21 of the loop element 14*a* is formed at a position that is set from the position closest to the strip conductor 12 by 90° in the +Y direction, currents 22*a* and 22*b* occur in the loop element 14*a* in directions indicated by arrows a and b, respectively.

As a result, the loop element 14*a* operates as a radiation element that produces polarization in the Y direction which is parallel with the strip conductor 12. Whereas in FIG. 2 the cut is formed in the loop element 14*a* on the +Y side, polarization is likewise produced in the Y-axis direction also in a case that a cut is formed in the loop element 14*a* on the −Y side.

The power other than the radiation power of the loop element 14*a* consists of transmission power Pth and reflection power Pref that returns to the input terminal 15 due to impedance unmatching between the strip conductor 12 and the loop element 14*a*. Therefore, the radiation power of the loop element 14*a* is equal to the input power Pin minus the transmission power Pth and the reflection power Pref. The transmission power Pth becomes input power of the loop element 14*b*. Each of the following loop elements 14*c*, 14*d*, and 14*e* operates in the same manner.

Figure 3:
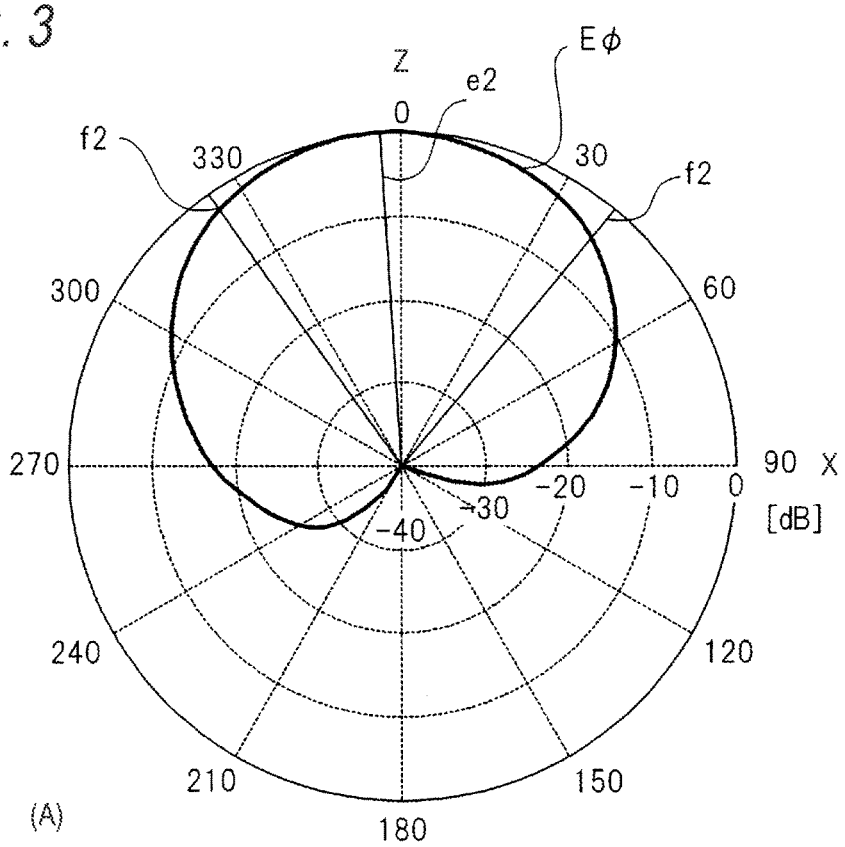
FIGS. 3(A) and 3(B) show radiation patterns of the planar array antenna.
Figure 3:
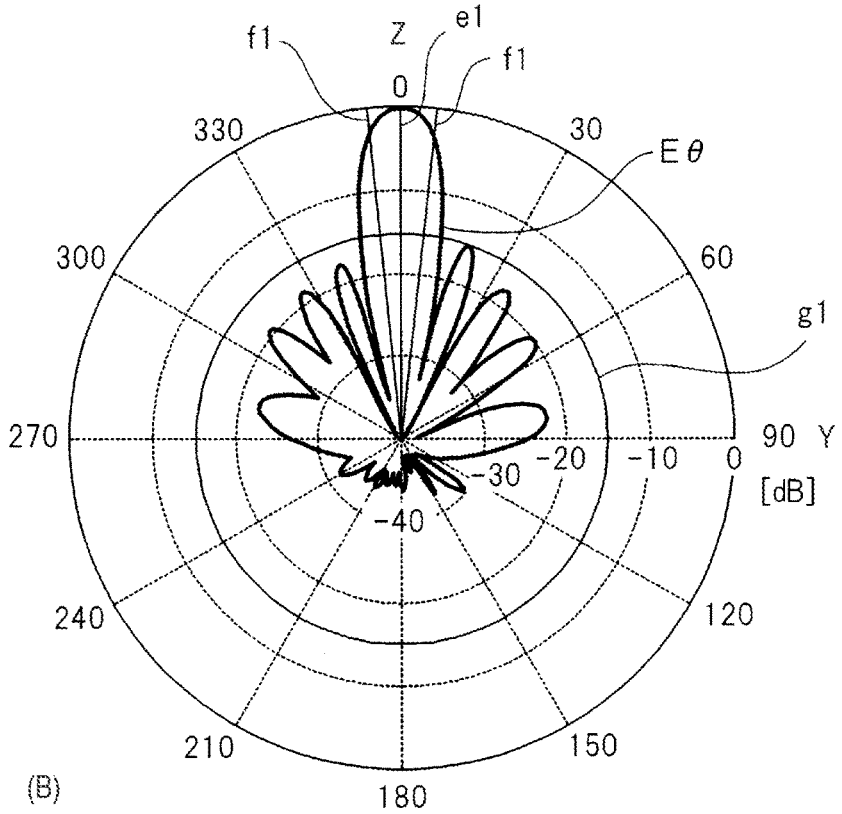

FIGS. 3(A) and 3(B) show radiation patterns of the planar array antenna 10. FIG. 3(A) shows a radiation pattern of a horizontal polarization component ($E_\phi$) in the X-Z plane. FIG. 3(B) shows a radiation pattern of a vertical polarization ($E_\theta$) component in the Y-Z plane. In FIGS. 3(A) and 3(B), symbols e2 and e1 indicate maximum gain directions, symbols f2 and f1 indicate half-width directions (i.e., directions in which the gain is 3 dB lower than a maximum gain), and symbol g1 indicates a maximum gain of sidelobes.

As described above, in the planar array antenna 10, since the loop elements 14*a*, 14*b*, 14*c*, 14*d*, and 14*e* are arranged at distances of one wavelength, whereby excitation occurs at the same phase and the maximum radiation direction is the Z direction. In the planar array antenna 10, a narrow beam radiation characteristic is obtained in the Y-Z plane.

In the planar array antenna 10, since the circumferential length of each loop element is approximately equal to one wavelength of radiated radio waves, the two currents 22*a* and 22*b* shown in FIG. 2 occur and hence a high gain is realized. Furthermore, in the planar array antenna 10, the cut is formed in each loop element to make it an open loop, whereby currents occur in each of the loop elements 14*a*, 14*b*, 14*c*, 14*d*, and 14*e* and the polarization direction that is the same as the traveling direction of the strip conductor 12 (i.e., the polarization in the +Y-axis direction) can be obtained.

Figure 4:
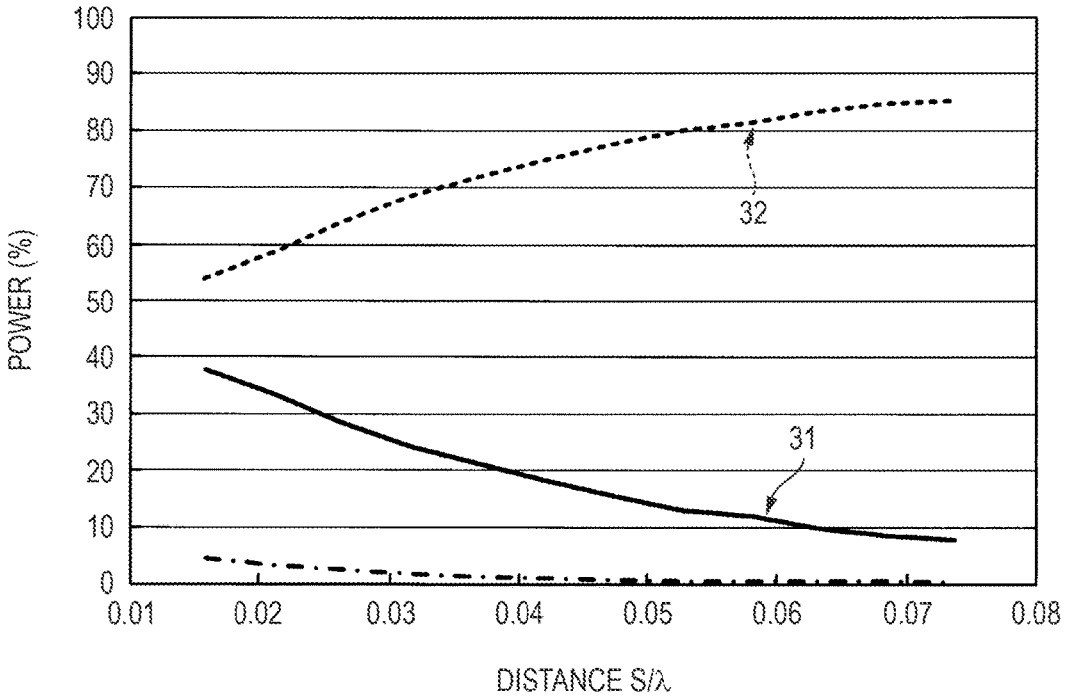
FIG. 4 is a graph showing how the radiation power, the transmission power, and the reflection power vary with the distance S between a strip conductor and each loop element.

FIG. 4 is a graph showing how the radiation power, the transmission power, and the reflection power vary with the distance S between the strip conductor 12 and the loop element 14*a*. Each kind of power is a percentage with respect to the input power (100%). The radiation power 31, the transmission power 32, and the reflection power 33 are represented by a solid line, a broken line, and a chain line, respectively.

In FIG. 4, the thickness t of the dielectric substrate 11 is equal to 0.067λ (λ: free space wavelength at an operating frequency), the relative permittivity $\in_r$ of the dielectric substrate 11 is equal to 2.2, the radius R of the loop element 14*a* is set at 0.12λ, and the element width W of the loop element 14*a* is set at 0.04λ.

As seen from the graph of FIG. 4, the radiation power increases as the distance S decreases. This is because the electromagnetic coupling between the strip conductor 12 and the loop element 14*a* becomes stronger as the distance S decreases. As the distance S decreases, the reflection power also increases and hence the radiation efficient lowers in spite of the increase of the radiation power.

As described above, in the planar array antenna 10 according to the first embodiment, the radiation power of each loop element 14, and hence the excitation distribution of each loop element 14, can be adjusted by varying the distance S between the strip conductor 12 and each loop element 14. Therefore, in the planar array antenna 10 according to this embodiment, high-gain radiation can be realized by suppressing the level of sidelobes with respect to that of a main beam and thus controlling the directivity characteristic.

Modifications of Embodiment 1

In the graph of FIG. 4, the radiation power varies from 8% to 38% by adjusting the distance S between the strip conductor 12 and each loop element 14. As a result, the adjustment range of the excitation distribution of each loop element is narrow.

Figure 5:
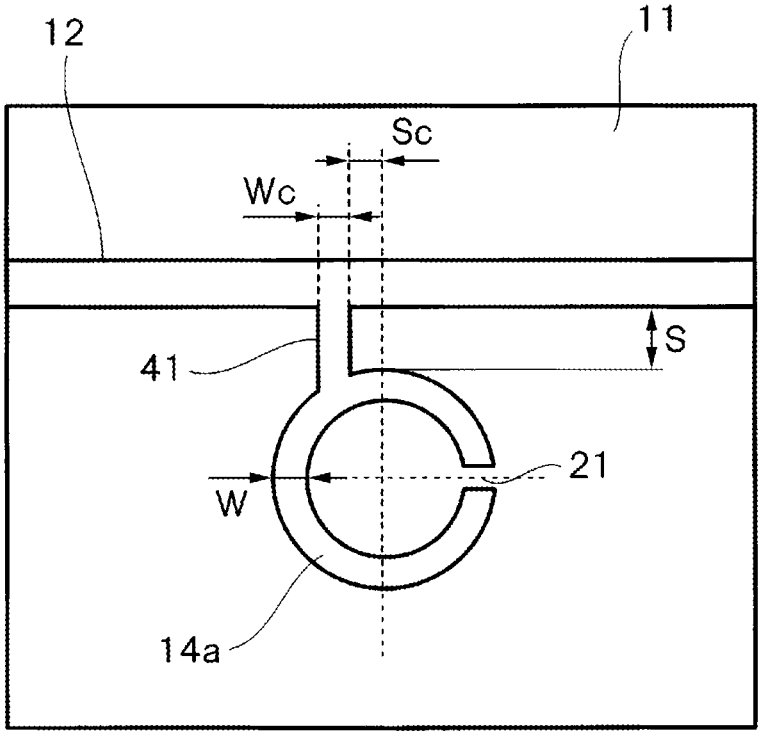
FIG. 5 is a plan view of a loop element and its vicinity of an example in which the loop element is connected directly (physically) to the strip conductor using a connection element.

Modifications of the first embodiment are examples in which the electromagnetic coupling between the strip conductor 12 and the loop element 14*a* is made stronger than in the planar array antenna 10 according to the first embodiment. FIG. 5 is a plan view of the loop element 14*a* and its vicinity of an example in which the loop element 14*a* is connected directly (physically) to the strip conductor 12 using a connection element 41.

The electromagnetic coupling between the strip conductor 12 and the loop element 14*a* is made even stronger and the radiation power of the loop element 14*a* can be increased by directly connecting the loop element 14*a* to the strip conductor 12 using the connection element 41.

Figure 6:
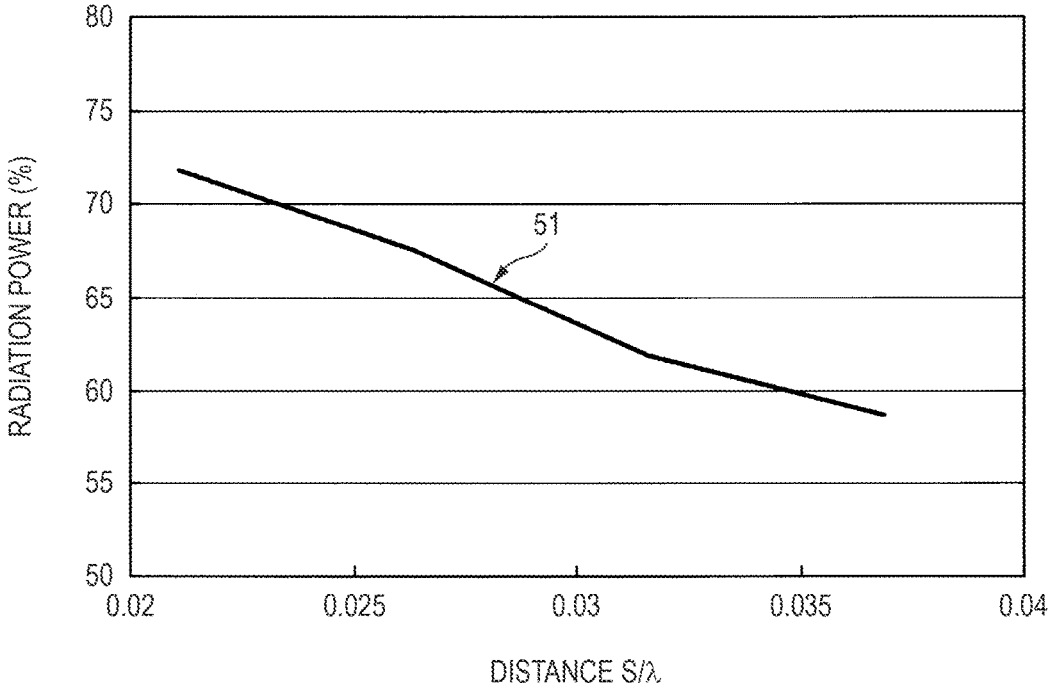
FIG. 6 is a graph showing how the radiation power varies with the distance S between the strip conductor and the loop element shown in FIG. 5.

FIG. 6 is a graph showing how the radiation power 51 varies with the distance S between the strip conductor 12 and the loop element 14*a* shown in FIG. 5. The element width We of the connection element 41 is set at 0.026λ and the distance Sc between the center of the loop element 14*a* and the connection element 41 is set at 0.026λ. As seen from the graph of FIG. 6, the radiation power 51 of the loop element 14*a* is made higher than the radiation power 31 shown in FIG. 4 by directly connecting the loop element 14*a* to the strip conductor 12 using the connection element 41.

Figure 7:
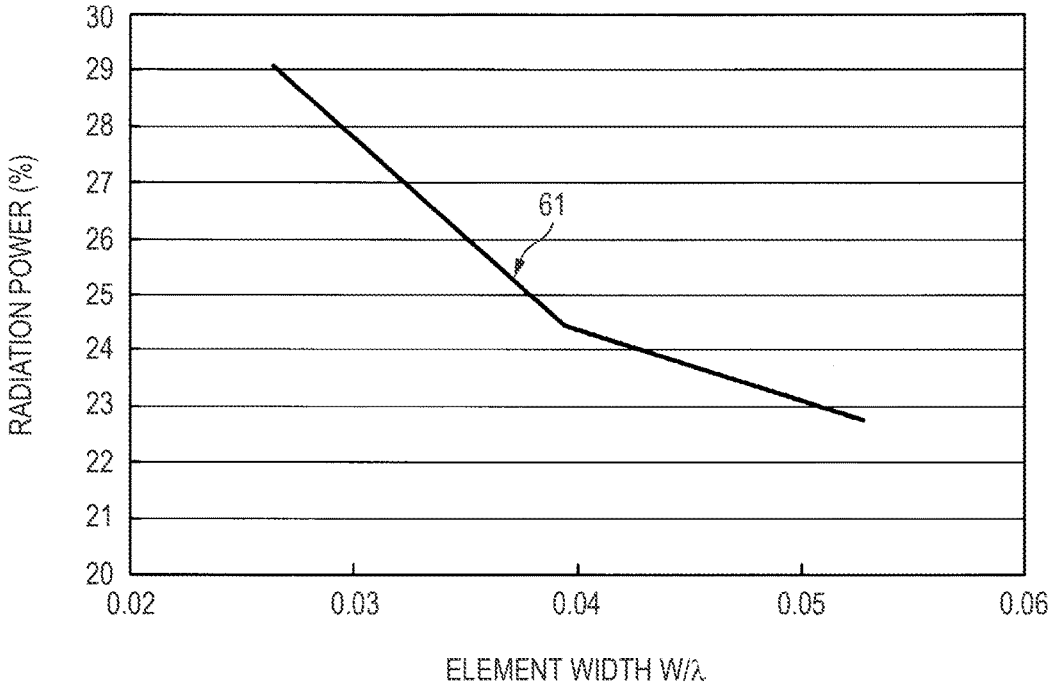
FIG. 7 is a graph showing how the radiation power varies with the element width W of the loop element shown in FIG. 2.

FIG. 7 is a graph showing how the radiation power 61 varies with the element width W of the loop element 14*a* shown in FIG. 2. The distance S between the strip conductor 12 and the loop element 14*a* is set at 0.032λ. As seen from the graph of FIG. 7, the radiation power 61 can also be adjusted by changing the element width W.

That is, the adjustment range of the radiation power of each loop element can be widened by combining varying of the distance between the strip conductor and each loop element with the method of connection between the strip conductor and each loop element and varying of the element width of each loop element.

Therefore, in the planar array antenna 10 according to this modification, the adjustment range of each of the loop elements 14*a*, 14*b*, 14*c*, 14*d*, and 14*e* can be widened and hence required directivity of radiated radio waves can be realized so as to satisfy a design specification of a planar array antenna.

Figure 8:
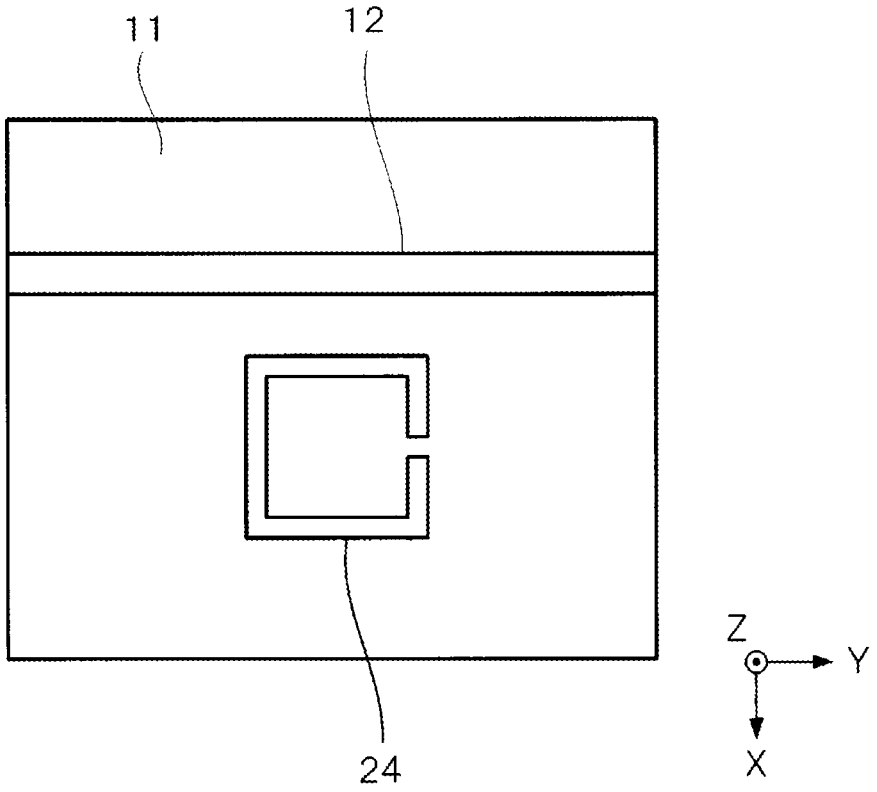
FIG. 8 is a plan view showing a rectangular (or square) loop element 24 and its vicinity.

Whereas in the first embodiment and this modification the circular loop elements are used, in each of the embodiments including the first embodiment and this modification the same advantages can also be obtained by using rectangular (or square) loop elements. FIG. 8 shows a structure of a rectangular (or square) loop element 24 and its vicinity. Like the loop element 14*a* shown in FIG. 2, the loop element 24 shown in FIG. 8 has an open loop structure with a cut in which the circumferential length is approximately equal to one wavelength of radiated radio waves.

Figure 9:
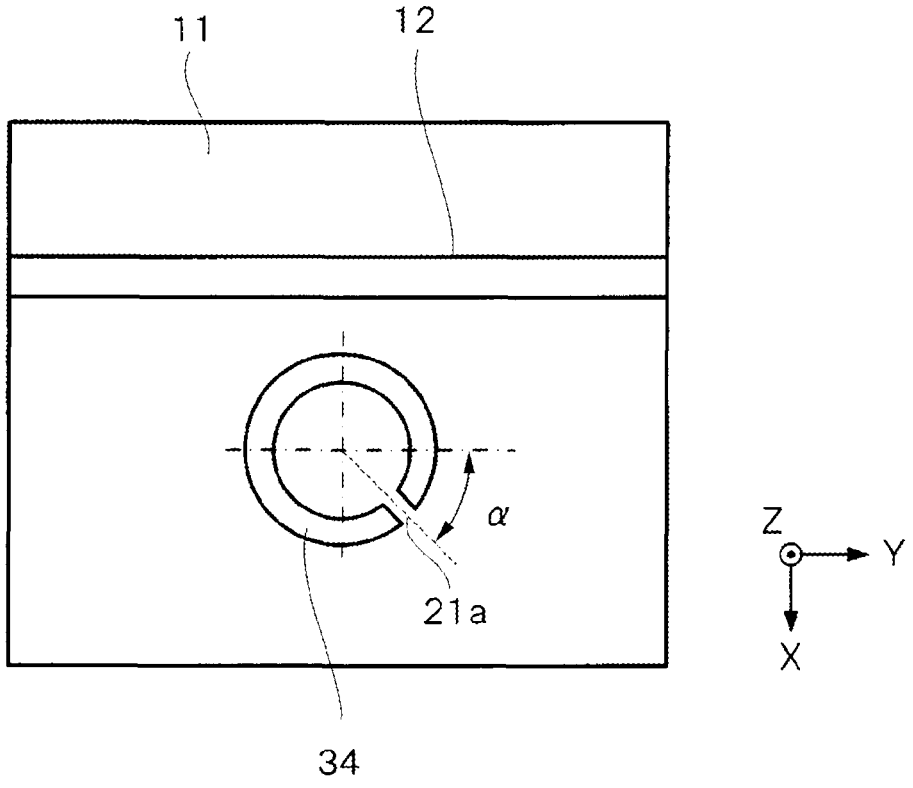
FIG. 9 is a plan view of a cutting-position-changed loop element 34 and its vicinity.

The polarization direction can be adjusted as appropriate by changing the cutting position (angle α) of each loop element. FIG. 9 is a plan view of a cutting-position-changed loop element 34 and its vicinity. Let symbol α represent the angle of the cutting position (opening 21*a*) as measured from the +Y-axis direction. For example, when α=0° (see FIGS. 1 and 2), polarization in the +Y-axis direction can be obtained.

That is, the planar array antenna 10 according to the first embodiment can radiate polarized waves that are polarized in the same direction as the signal traveling direction of the strip conductor 12. When α=45° (see FIG. 9), the planar array antenna 10 can radiate polarized waves that are polarized in the direction that is set by 45° from the +Y-axis direction.

When α=90°, the planar array antenna 10 can radiate polarized waves that are polarized in the +X-axis direction. Instead of the open loop structure in which each loop element has a cut, a closed loop structure may be employed in which each loop element is provided with a perturbation element.

Figure 10:
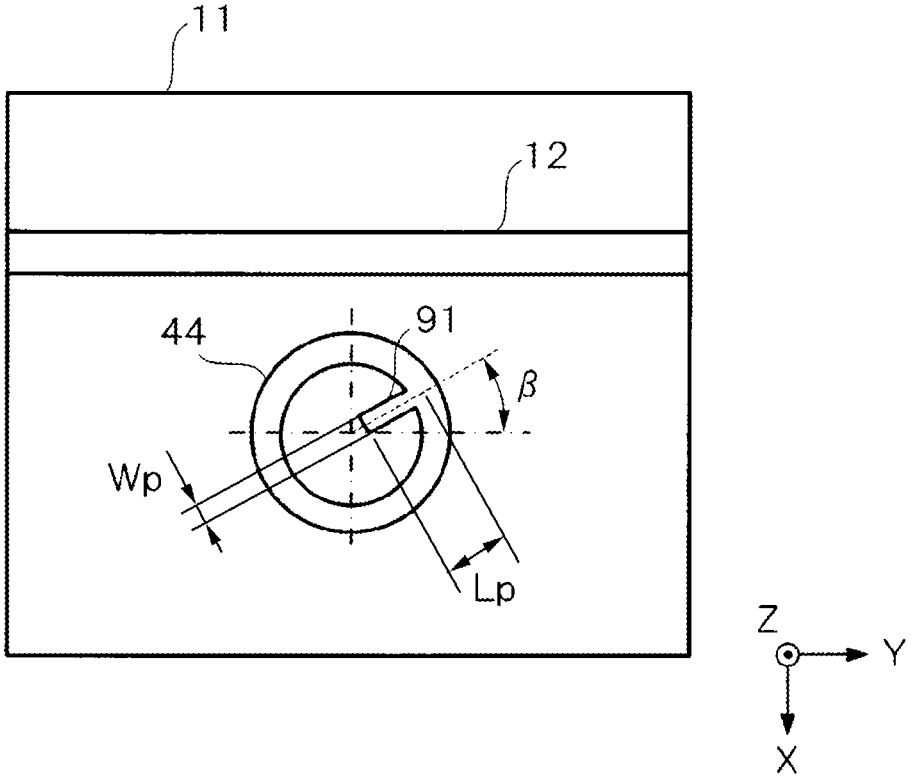
FIG. 10 is a plan view of a loop element 44 provided with a perturbation element 91 and its vicinity.

FIG. 10 is a plan view of a loop element 44 provided with a perturbation element 91 and its vicinity. Provided with the perturbation element 91, the loop element 44 can radiate circularly polarized waves. For example, the loop element 44 can radiate right-handed polarized waves when the element width Wp, element length Lp, and angle β of the perturbation element 91 are set at 0.026λ, 0.094λ, and 30°, respectively.

Figure 22:
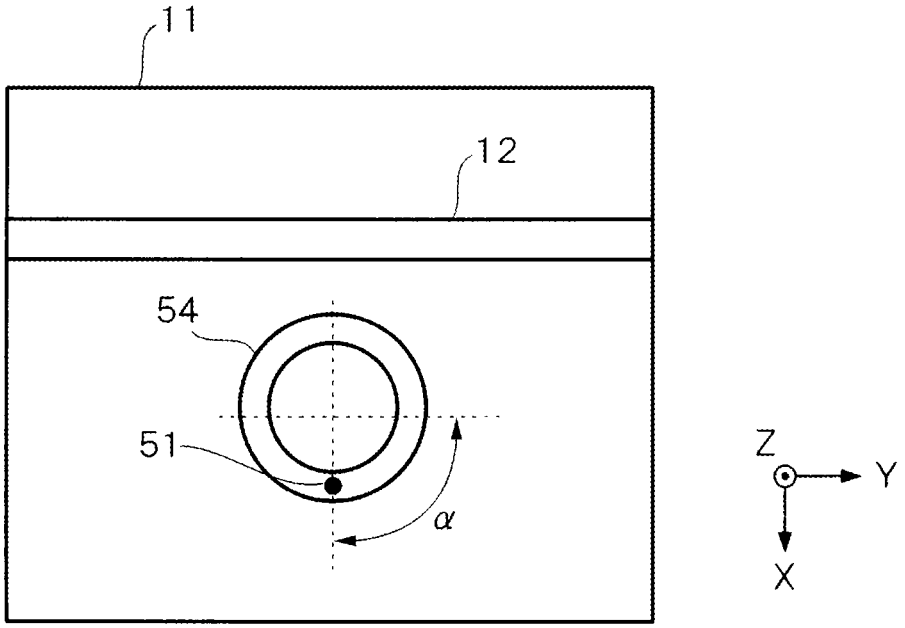
FIG. 22(A) is a plan view of a closed loop element 54 which is electrically connected to a conductor plate 13 by a conductive connection portion 51 as well as its vicinity.
FIG. 22(B) is a sectional view of the closed loop element 54 which is electrically connected to the conductor plate 13 by the conductive connection portion 51 as well as its vicinity.
Figure 22:
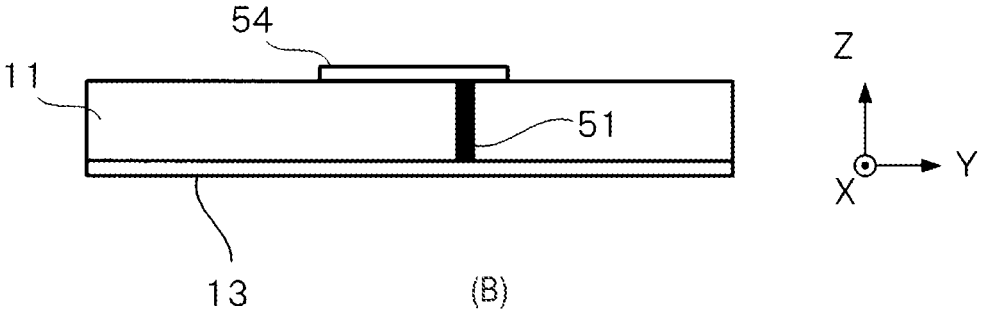

FIG. 22(A) is a plan view of a closed loop element 54 which is electrically connected to the conductor plate 13 by a conductive connection portion 51 as well as its vicinity. FIG. 22(B) is a sectional view of the closed loop element 54 which is electrically connected to the conductor plate 13 by the conductive connection portion 51 as well as its vicinity. As shown in FIGS. 22(A) and 22(B), part of the closed loop element 54 is electrically connected to the conductor plate 13 by the conductive connection portion 51. The conductive connection portion 51 can be formed by using a through-hole. The polarization direction can be adjusted as appropriate by changing the connecting position of the conductive connection portion 51 and the closed loop element 54, that is, the angle α shown in FIG. 22(A). Let symbol α represent the angle of the connecting position of the conductive connection portion 51 and the closed loop element 54 as measured from the +Y-axis direction. For example, when α=90°, polarization in the +Y-axis direction can be obtained.

As described above, the planar array antennas 10 according to the modifications can generate various polarized waves by adjusting the cutting position of each loop element or adding a perturbation element instead of forming a cut and hence can secure a degree of freedom of designing that is suitable for a required specification.

Embodiment 2

The first embodiment is directed to the planar array antenna 10 in which not only the radiation power but also the reflection power increases as the distance S between the strip conductor 12 and each loop element 14*a* decreases. A second embodiment is directed to an example planar array antenna whose reflection power decreases.

Figure 11:
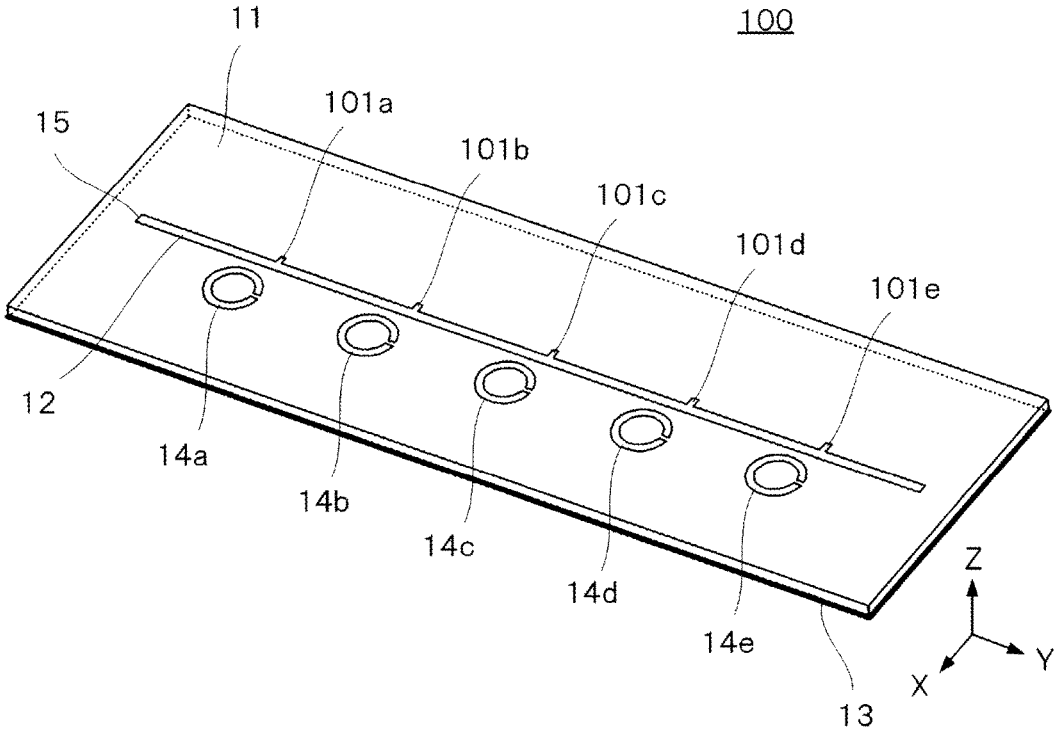
FIG. 11 is a perspective view showing the configuration of a planar array antenna according to a second embodiment.

FIG. 11 is a perspective view showing the configuration of a planar array antenna 100 according to the second embodiment. Since the planar array antenna 100 according to this embodiment is similar in configuration to the planar array antenna 10 according to the first embodiment, constituent elements having the same ones in the planar array antenna 10 according to the first embodiment will be given the same symbols as the latter and descriptions therefor will be omitted. Only different constituent elements will be described below.

The planar array antenna 100 is different in configuration from the planar array antenna 10 according to the first embodiment in that the strip conductor 12 is formed with matching elements 101*a*, 101*b*, 101*c*, 101*d*, and 101*e*. The matching elements 101*a*, 101*b*, 101*c*, 101*d*, and 101*e* project from the strip conductor 12 in the direction (+X-axis or −X-axis direction) that is perpendicular to the longitudinal direction (+Y-axis or −Y-axis direction) of the strip conductor 12 at such positions as to correspond to the respective loop elements 14*a*, 14*b*, 14*c*, 14*d*, and 14*e*.

Figure 12:
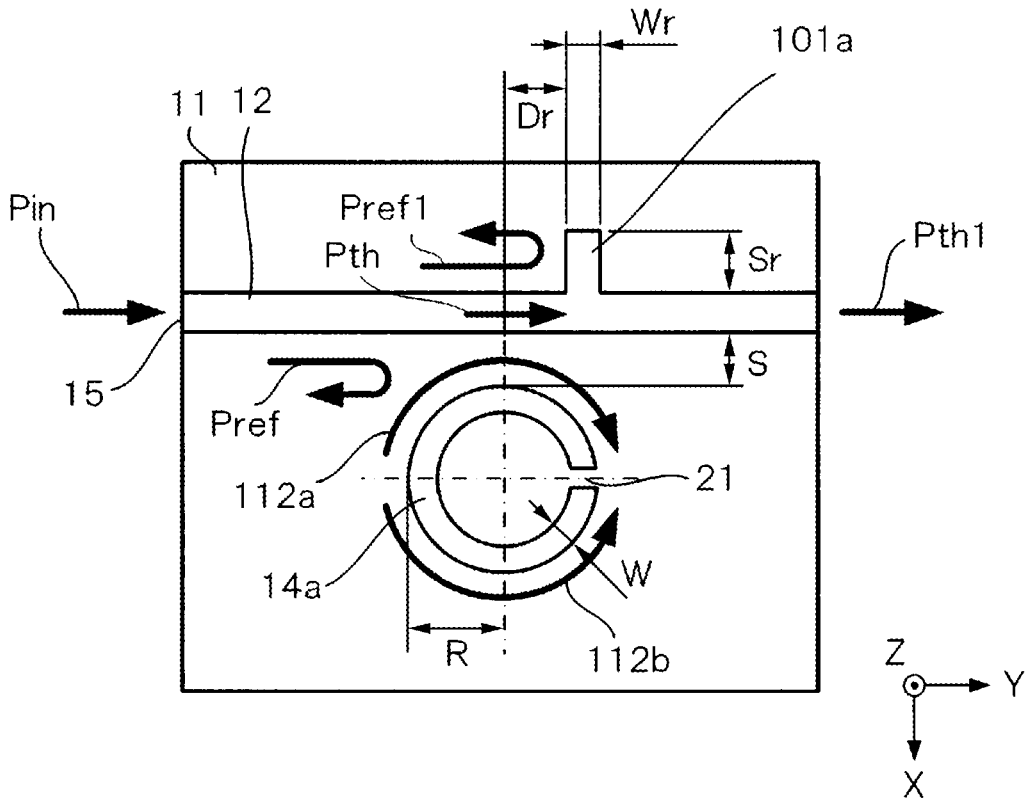
FIG. 12 is a plan view of a loop element of the planar array antenna according to the second embodiment and its vicinity.

Next, the principle of radiation of radio waves from each of the loop elements 14*a*, 14*b*, 14*c*, 14*d*, and 14*e* of the planar array antenna 100 according to this embodiment will be described with reference to FIG. 12. FIG. 12 is a plan view of the loop element 14*a* of the planar array antenna 100 according to the second embodiment and its vicinity.

Part of power Pin that is input to the input terminal 15 is radiated from the loop element 14*a* through the electromagnetic coupling between the strip conductor 12 and the loop element 14*a*. That is, currents 112*a* and 112*b* occur in the loop element 14*a* in the same manner as in the first embodiment and power is radiated from the loop element 14*a*.

The power other than the radiation power of the loop element 14*a* consists of transmission power Pth and reflection power Pref that returns to the input terminal 15 due to impedance unmatching between the strip conductor 12 and the loop element 14*a*.

Part of the transmission power Pth becomes reflection power Pref1 that is reflected due to impedance unmatching that is caused by the presence of the matching element 101*a* and returns to the input end 15. However, most of the transmission power Pth travels through the strip conductor 12 as transmission power Pth1.

In this embodiment, the length Sr, the element width Wr, and the distance Dr from the center position of the loop element 14*a* of the matching element 101*a* are determined so that the reflection power Pref from the loop element 14*a* and the reflection power Pref1 from the matching element 101*a* have opposite phases. That is, the shape and the position of the matching element 101*a* are determined so that opposite-phase reflection waves that suppress reflection waves from the loop element 14*a* are generated. With this measure, the planar array antenna 100 according to this embodiment can reduce the power that is reflected toward the input end 15 and thereby increase the radiation efficiency.

The loop element 14*b* whose input power is equal to the transmission power Pth1 operates in the same manner as the loop element 14*a*. The loop elements 14*c*, 14*d*, and 14*e* operate in the same manner in this order.

Figure 13:
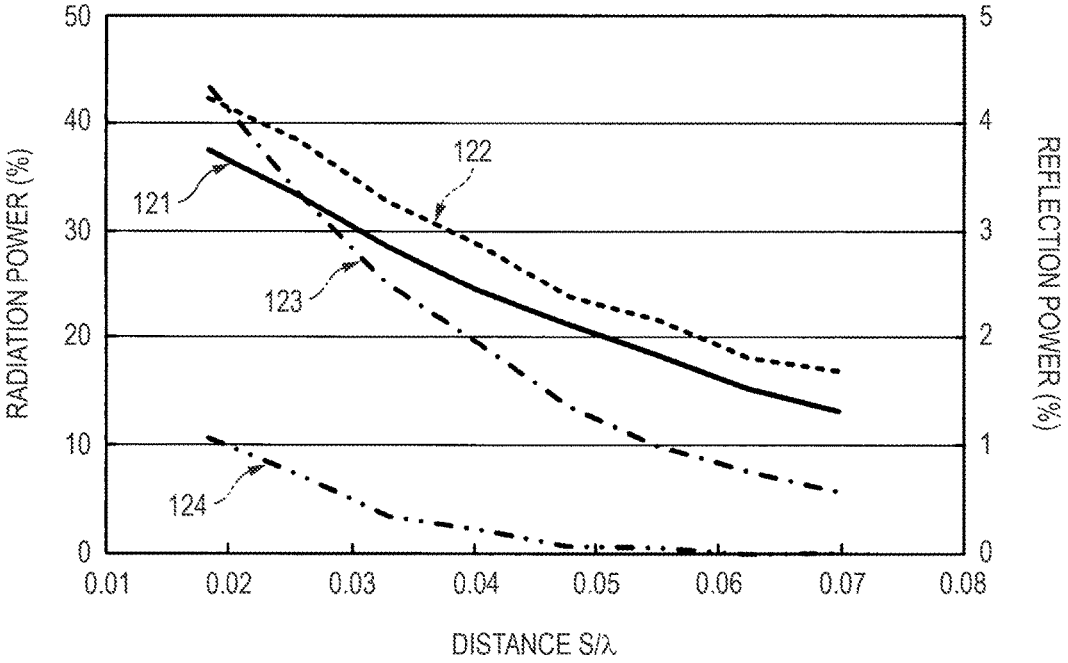
FIG. 13 is a graph showing how the radiation power and the reflection power vary with the interval S between the strip conductor and each loop element.

FIG. 13 is a graph showing how the radiation power and the reflection power vary with the distance S between the strip conductor 12 and the loop element 14*a*. The graph of FIG. 13 shows characteristics of the radiation power and the reflection power with and without the matching element 101*a*. The left-hand vertical axis and the right-hand vertical axis of FIG. 13 represent the radiation power (%) and the reflection power (%), respectively.

A solid-line radiation power curve 121 and a chain-line reflection power curve 123 are characteristics without the matching element 101*a* (see FIG. 2). On the other hand, a broken-line radiation power curve 122 and a two-dot-chain-line reflection power curve 124 are characteristics with the matching element 101*a* (see FIG. 12).

For example, when the distance S is set equal to 0.036λ, the length Sr, the element width Wr, and the distance Dr of the matching element 101*a* are set at 0.074λ, 0.026λ, and 0.11λ, respectively, and the radius R and the element width W of the loop element 14*a* are set at 0.14λ and 0.04λ, respectively. As seen from the graph of FIG. 13, by virtue of the presence of the matching element 101*a*, the planar array antenna 100 can reduce the reflection power and increase the radiation power.

As described above, in the planar array antenna 100 according to the second embodiment, the strip conductor 12 is provided with the matching elements 101*a*, 101*b*, 101*c*, 101*d*, and 101*e* and each matching element produces reflection power for suppressing reflection power from the corresponding one of the loop elements 14*a*, 14*b*, 14*c*, 14*d*, and 14*e*. With this measure, the planar array antenna 100 according to this embodiment can reduce the reflection power and increase the radiation power and hence can make the radiation efficiency even higher than the planar array antenna 10 according to the above embodiment.

Embodiment 3

In the planar array antenna according to each of the above-described embodiments, the power that is input to the input end 15 is electromagnetically coupled with and thereby radiated from the loop elements 14*a*, 14*b*, 14*c*, 14*d*, and 14*e* in this order. Therefore, the power that travels through the strip conductor 12 attenuates gradually. However, residual power remains that passes through the loop element 14*e* without being radiated from it. The residual power does not contribute to radiation of radio waves of the planar array antenna and hence causes reduction of the radiation efficiency.

Figure 14:
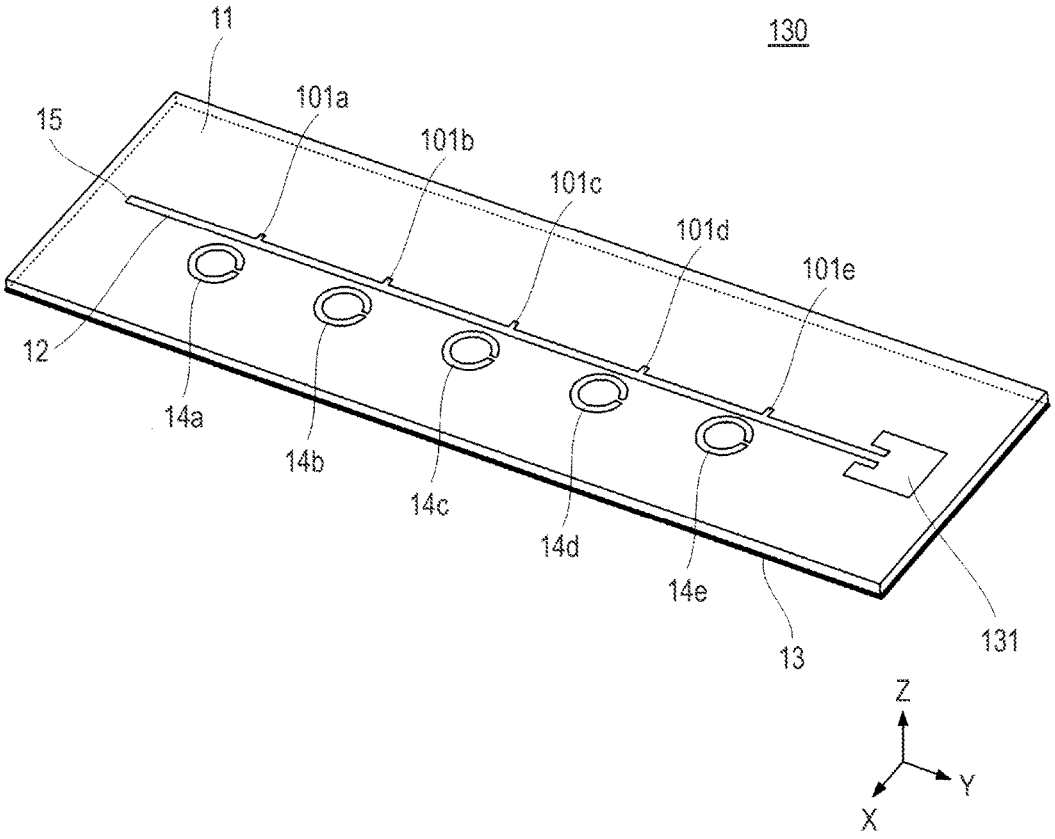
FIG. 14 is a perspective view showing the configuration of a planar array antenna according to a third embodiment.

A third embodiment is directed to an example planar array antenna which also radiates residual power effectively that occurs in the planar array antenna according to each of the above-described embodiments. FIG. 14 is a perspective view showing the configuration of a planar array antenna 130 according to the third embodiment. Since the planar array antenna 130 according to the third embodiment is similar in configuration to the planar array antenna 100 according to the second embodiment, constituent elements having the same ones in the planar array antenna 100 according to the second embodiment will be given the same symbols as the latter and descriptions therefor will be omitted. Only different constituent elements will be described below.

The planar array antenna 130 is different in configuration from the planar array antenna 100 according to the second embodiment in that a microstrip antenna element 131 is provided at the output end (terminal) of the strip conductor 12.

The microstrip antenna element 131 as a strip antenna element receives transmission power that has passed through the loop element 14*e*, and radiates radio waves corresponding to residual power that has not been radiated from the loop elements 14*a*, 14*b*, 14*c*, 14*d*, and 14*e*.

As described above, in the planar array antenna 130 according to the third embodiment, the microstrip antenna element 131 radiates radio waves using residual power that passes through the loop element 14*e* without being radiated from it. With this measure, the planar array antenna 130 according to this embodiment can make the radiation efficiency even higher than the planar array antenna according to each of the above embodiments.

Although in this embodiment the antenna element provided on the output side is the rectangular microstrip antenna element, a circular microstrip antenna element may be used which can provide the same advantage.

Modification of Embodiment 3

Figure 15:
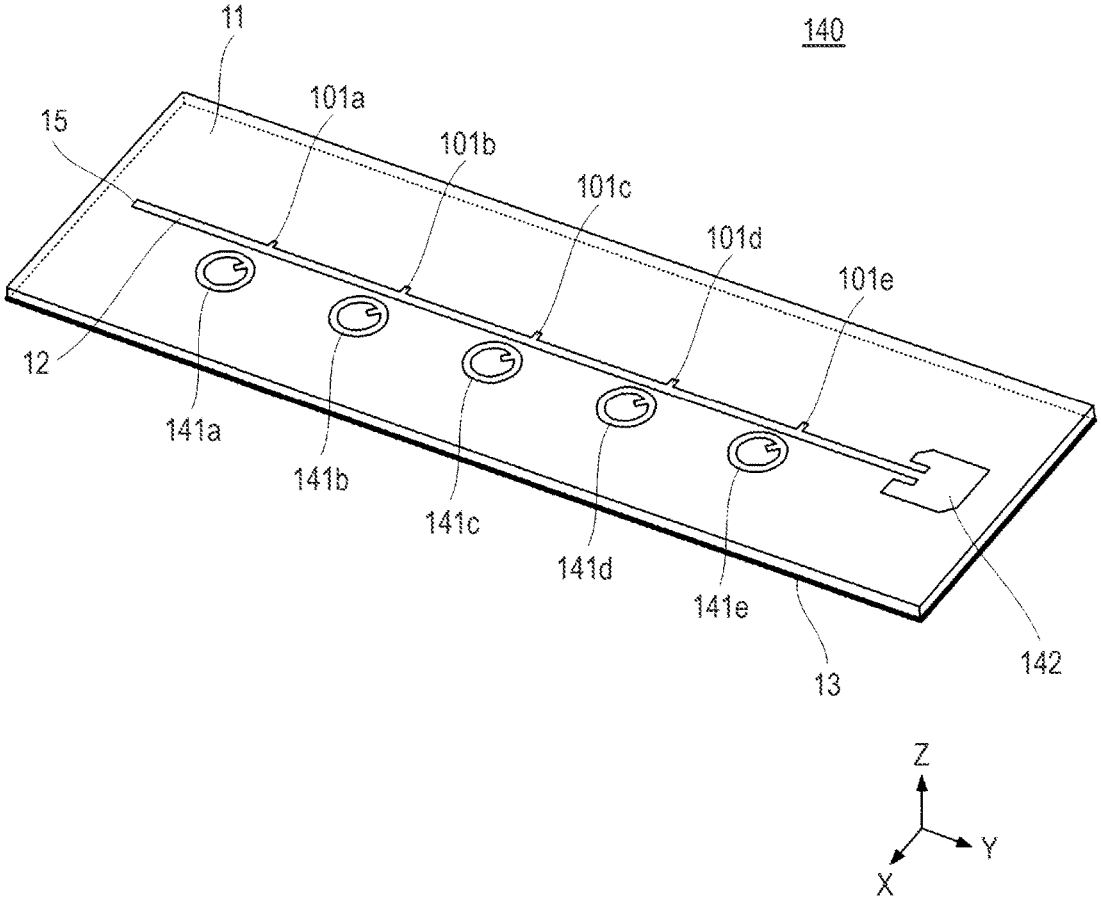
FIG. 15 is a perspective view showing the configuration of a planar array antenna which uses loop elements capable of providing a circularly polarization characteristic.

FIG. 15 is a perspective view showing the configuration of a planar array antenna 140 which uses loop elements 141*a*, 141*b*, 141*c*, 141*d*, and 141*e* capable of providing a circular polarization characteristic. The planar array antenna 140 is further equipped with the loop elements 141*a*, 141*b*, 141*c*, 141*d*, and 141*e* each having a perturbation element and a microstrip antenna element 142 having cuts and perturbation elements.

The microstrip antenna element 142 receives transmission power that has passed through the loop element 141*e*, and radiates radio waves corresponding to residual power that has not been radiated from the loop elements 141*a*, 141*b*, 141*c*, 141*d*, and 141*e*.

Configured as described above, the planar array antenna 140 according to the modification can attain radiation efficiency on the same level as the planar array antenna 130 according to the third embodiment and, in addition, provide a circular polarization characteristic.

Embodiment 4

A fourth embodiment is directed to example planar array antennas in each of which loop elements that are used in the planar array antennas according to the above embodiments and their modifications are combined in such a manner as to be in different sets of conditions (e.g., the radius R, the element width W, and the interval S between the strip conductor 12 and the loop element). A case that the loop elements are excited uniformly and a case that the loop elements have different radiation power ratios will be compared with each other. The uniform excitation means radiation in which all loop elements have the same ratio of the radiation power to the input power (radiation power ratio).

Figure 16:
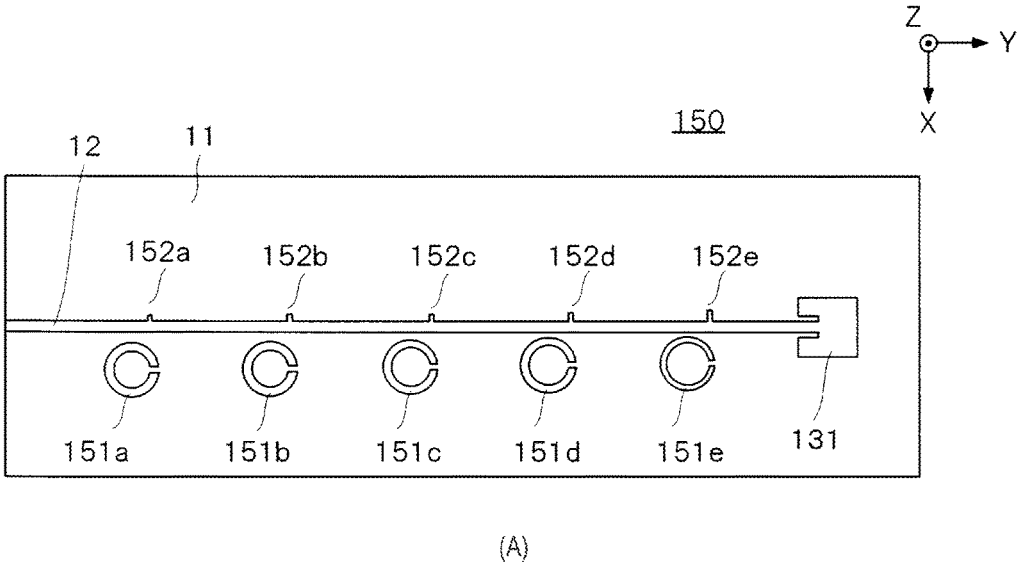
FIG. 16(A) is a plan view showing the configuration of a planar array antenna in which loop elements are excited uniformly.
FIG. 16(B) shows the configuration of a planar array antenna in which loop elements have different radiation power ratios.
Figure 16:
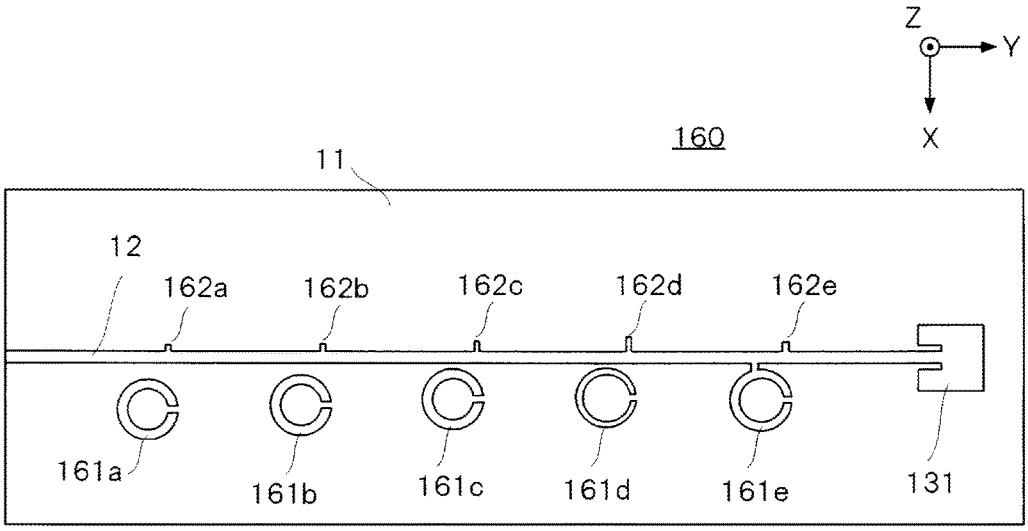

FIG. 16(A) is a plan view showing the configuration of a planar array antenna 150 in which loop elements 151*a*, 151*b*, 151*c*, 151*d*, and 151*e* are excited uniformly. FIG. 17(A) is a table showing a radiation power ratio and radiation-power-to-input-power ratios in percentage of the respective loop elements 151*a*, 151*b*, 151*c*, 151*d*, and 151*e* of the planar array antenna 150 shown in FIG. 16(A).

In the example of FIG. 17(A), the radiation power ratio (Pin−Pth of loop element 151*a*): (Pin−Pth of loop element 151*b*): (Pin−Pth of loop element 151*c*): (Pin−Pth of loop element 151*d*): (Pin−Pth of loop element 151*e*) is equal to 1:1:1:1:1.

In the example of FIG. 17(A), the radiation-power-to-input-power ratio {(Pin−Pth of loop element 151*a*)/(Pin of loop element 151*a*)}×100 is equal to 16.2%. The radiation-power-to-input-power ratio {(Pin−Pth of loop element 151*b*)/(Pin of loop element 151*b*)}×100 is equal to 19.5%. The radiation-power-to-input-power ratio {(Pin−Pth of loop element 151*c*)/(Pin of loop element 151*c*)}×100 is equal to 24.6%. The radiation-power-to-input-power ratio {(Pin−Pth of loop element 151*d*)/(Pin of loop element 151*d*)}×100 is equal to 33.0%. The radiation-power-to-input-power ratio {(Pin−Pth of loop element 151*e*)/(Pin of loop element 151*e*)}×100 is equal to 49.7%.

In the example of FIG. 17(A), numerical values are set taking into consideration a loss in the strip conductor 12. To realize uniform excitation, the radiation power values of the respective loop elements 151*a*, 151*b*, 151*c*, 151*d*, and 151*e* are set in a range of 16.2% to 49.7%.

In the planar array antenna 150 shown in FIG. 16(A), to realize these radiation power values, the distances S between the strip conductor 12 and the respective loop elements 151*a*, 151*b*, 151*c*, 151*d*, and 151*e* and the loop element widths W are adjusted. For example, in the loop element 151*a*, the distance S between it and the strip conductor 12 and the loop element width W are large. On the other hand, in the loop element 151*e*, the interval S between it and the strip conductor 12 and the loop element width W are small.

Furthermore, the length Sr, the element width Wr, and the distance Dr from the center position of the corresponding one of the loop element 151 (151*a*, 151*b*, 151*c*, 151*d*, and 151*e*) of each of matching elements 152 (152*a*, 152*b*, 152*c*, 152*d*, and 152*e*) are adjusted so that it generates reflection waves that are opposite in phase to reflection waves from the corresponding loop element 151.

However, when radio waves are radiated from the planar array antenna 150 by uniform excitation, the radiated radio waves have high sidelobes. The sidelobes of radiated radio waves can be suppressed by making the radiation power ratios of the loop elements 151*a*, 151*b*, 151*c*, 151*d*, and 151*e* different from each other.

FIG. 16(B) shows the configuration of a planar array antenna in which loop elements have different radiation power ratios. FIG. 17(B) is a table showing a radiation power ratio and radiation-power-to-input-power ratios in percentage of the respective loop elements of the planar array antenna 160 shown in FIG. 16(B).

In the example of FIG. 17(B), as in the example of FIG. 17(A), numerical values are set taking into consideration a loss in the strip conductor 12. In the example of FIG. 17(B), unlike in the case of uniform excitation (FIG. 17(A)), to reduce sidelobe level with respect to a main beam of radio waves radiated from the planar array antenna, the radiation power values of respective loop elements 161*a*, 161*b*, 161*c*, 161*d*, and 161*e* are set in a wide range of 8.7% to 63.7%.

That is, in the planar array antenna 160 according to this embodiment, sidelobes with respect to a main beam of radio waves radiated from the planar array antenna can be made even lower than in each of the above embodiments and their modifications by adjusting, in addition to the distance S between the strip conductor and the loop element, the connection method of the strip conductor and the loop element, the variation of the element width W of the loop element, and the length Sr, the element width Wr, and the distance Dr from the center position of the corresponding loop element 14 of the matching element (162*a*, 162*b*, 162*c*, 162*d*, or 162*e*).

As a result, the planar array antenna 160 according to this embodiment can increase the adjustment ranges of the radiation power values of the respective loop elements 161*a*, 161*b*, 161*c*, 161*d*, and 161*e* and thereby radiate radio waves having radiation power values shown in FIG. 17(B).

As described above, in the planar array antenna 160 according to the fourth embodiment, the loop elements 161*a*, 161*b*, 161*c*, 161*d*, and 161*e* are combined in such a manner that they are adjusted as appropriate in terms of the distance S between the strip conductor and the loop element, whether the strip conductor and the loop element are connected directly to each other, the variation of the element width W of the loop element (if necessary), and the length Sr, the element width Wr, and the distance Dr from the center position of the corresponding loop element 14 of the matching element 162. As a result, the planar array antenna 160 according to this embodiment can make sidelobes with respect to a main beam of radio waves radiated from the planar array antenna even lower than in each of the above embodiments and their modifications by adjusting the radiation power values of the respective loop elements.

For example, the distance S between the loop element 161*a* and the strip conductor 12 is larger than that of each of the other loop elements 161*b*, 161*c*, 161*d*, and 161*e* and the loop element width W of the loop element 161*a* is greater than that of each of other loop elements 161*d* and 161*e*. And the loop element 161*e* is connected to the strip conductor 12 directly (physically) by the connection element.

Furthermore, the length Sr, the element width Wr, and the distance Dr from the center position of the corresponding loop element 161 of each matching element 162 are adjusted so that it generates reflection waves that are opposite in phase to reflection waves from the corresponding loop element 161.

Figure 18:
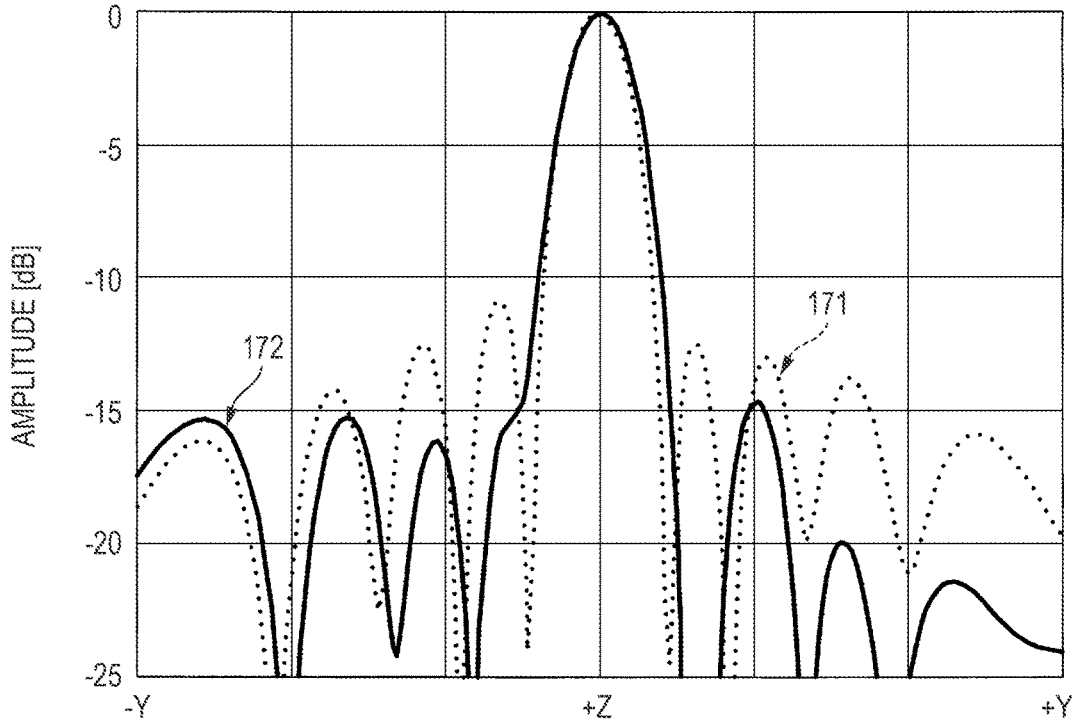
FIG. 18 is a graph showing radiation patterns of the planar array antennas in the Y-Z plane.
Figure 19:
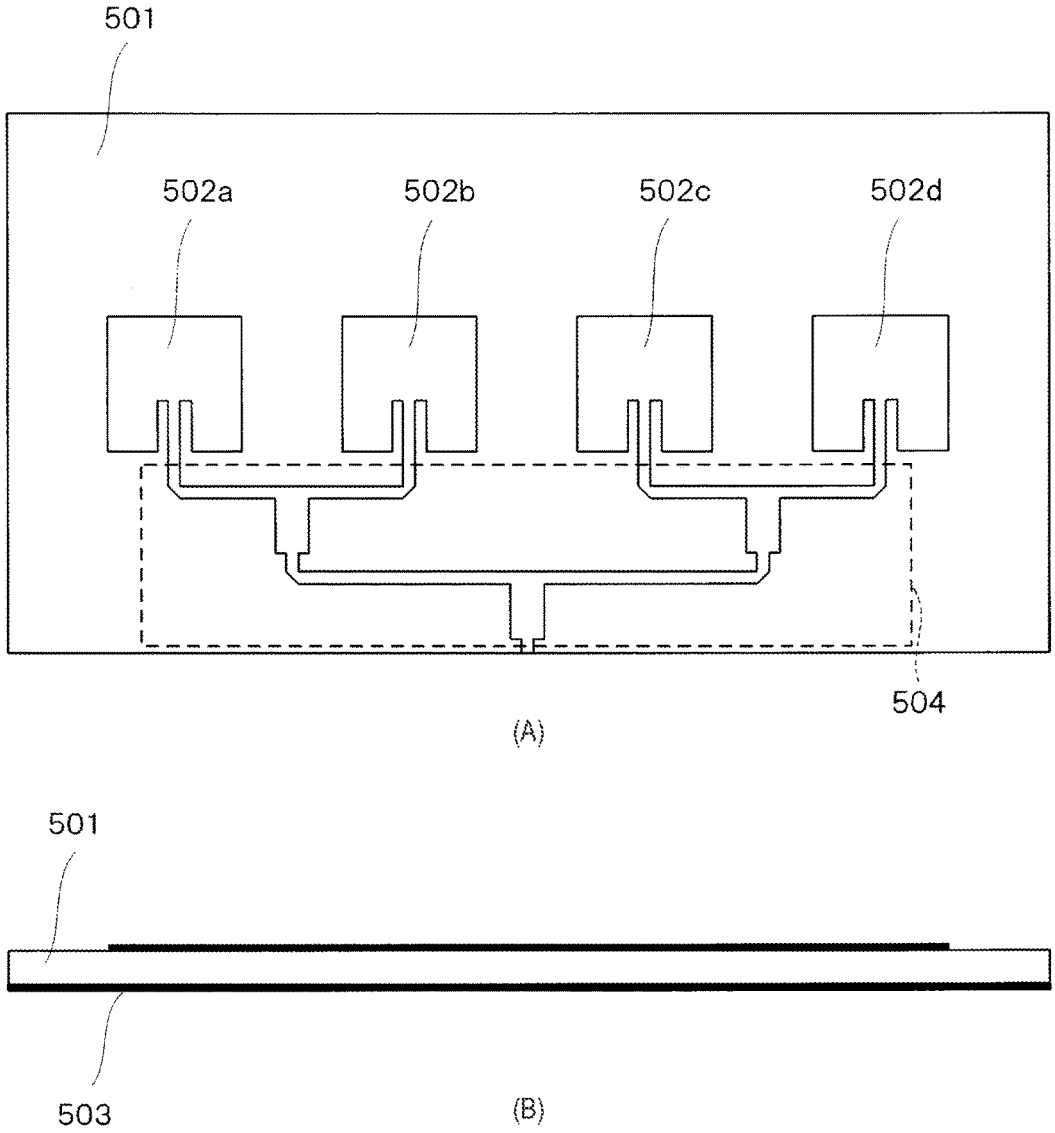
FIG. 19(A) is a plan view showing the configuration of a conventional patch array antenna in which four patch elements and a feeding circuit are arranged on the surface of a dielectric substrate.
FIG. 19(B) is a sectional view of the dielectric substrate.
Figure 20:
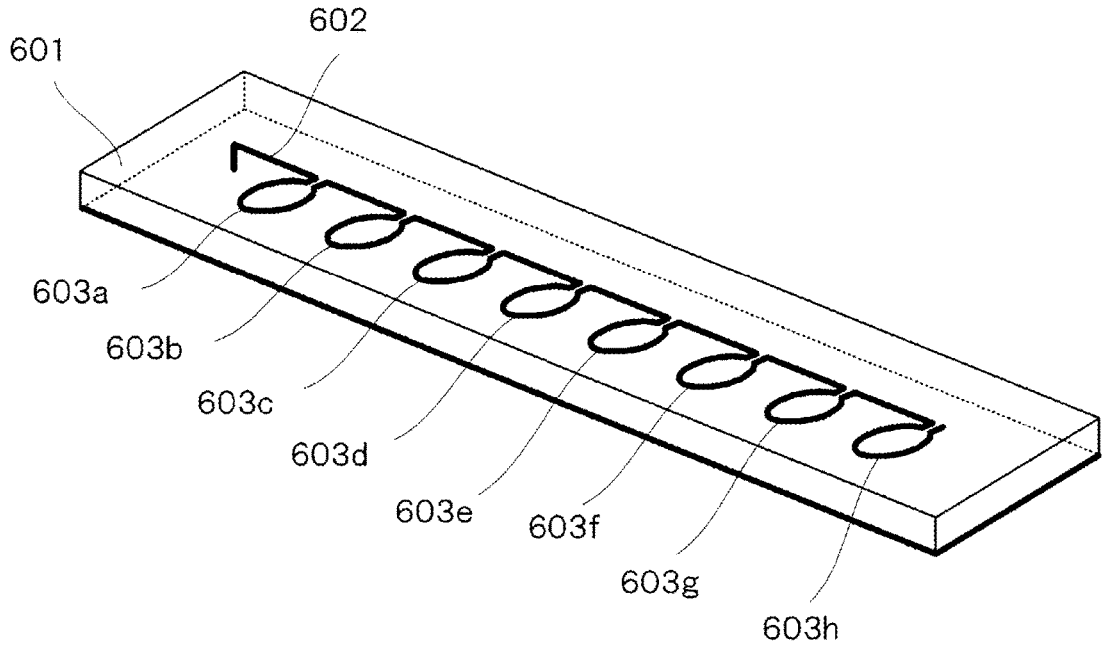
FIG. 20 is a perspective view showing the configuration of a loop-line array antenna as a conventional array antenna device.

FIG. 18 is a graph showing radiation patterns of the planar array antennas 150 and 160 in the Y-Z plane. In the graph of FIG. 18, a broken-line radiation pattern 171 is a radiation pattern of the planar array antenna 150 which is excited uniformly (see FIG. 16(A)). A solid-line radiation pattern 172 is a radiation pattern of the planar array antenna 160 in which the loop elements have different radiation power ratios (see FIG. 16(B)). As seen from FIG. 18, the sidelobes of the radiation pattern 172 are suppressed more than the sidelobes of the radiation pattern 171.

As described above, in the planar array antenna 160 according to the fourth embodiment, the adjustment ranges of the radiation power values of the respective loop elements can be controlled to a large extent by using the loop elements in different sets of conditions (e.g., the radius R, the element width W, the distance S between the strip conductor 12 and the loop element, and the length Sr, the element width Wr, and the distance Dr from the center position of the corresponding loop element of the matching element 162 (162*a*, 162*b*, 162*c*, 162*d*, or 162*e*) that are suitable for the respective loop elements, whereby planar array antennas having various excitation distributions can be provided. As such, the planar array antenna 160 according to this embodiment can suppress sidelobes with respect to a main beam and thereby realize high-gain radiation.

Embodiment 5

Figure 23:
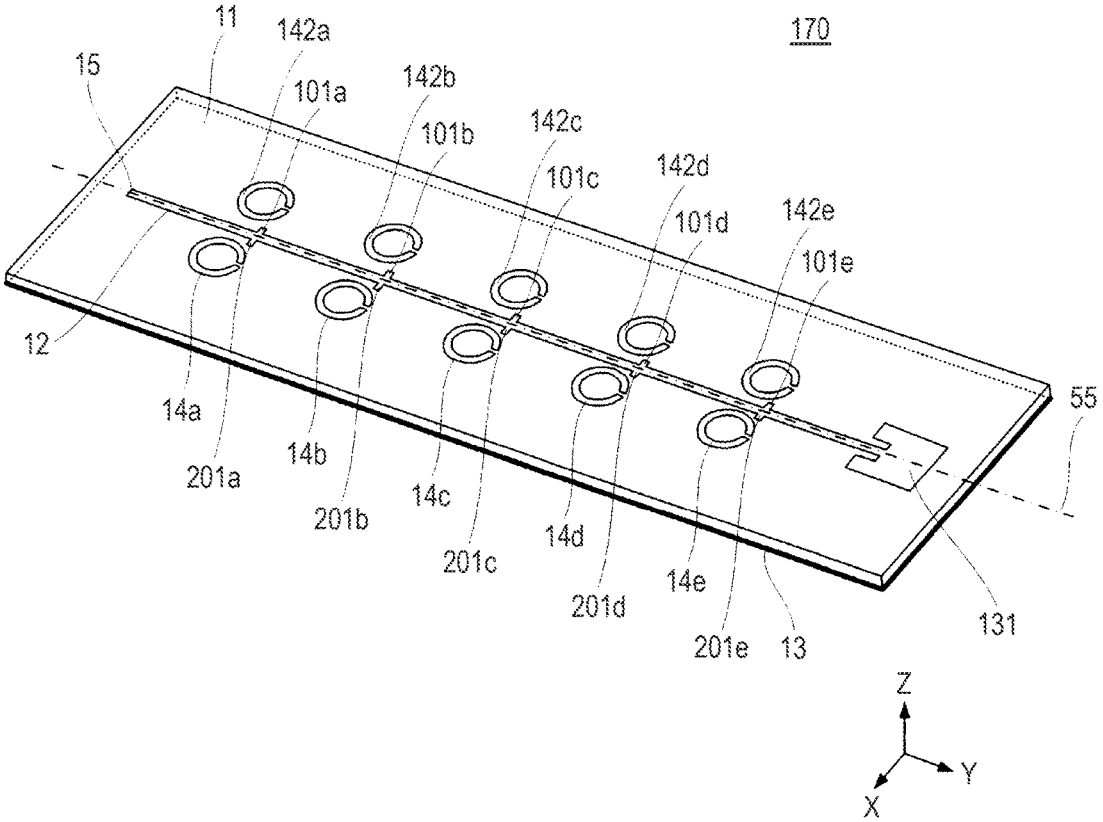
FIG. 23 is a perspective view showing the configuration of a planar array antenna according to a fifth embodiment.

FIG. 23 is a perspective view showing the configuration of a planar array antenna 170 according to a fifth embodiment. The planar array antenna 170 shown in FIG. 23 is configured in such a manner that loop elements are arranged symmetrically with respect to a center axis 55 of a strip conductor 12 which extends along the Y axis.

More specifically, loop elements 142*a*, 142*b*, 142*c*, 142*d*, and 142*e* and matching elements 201*a*, 201*b*, 201*c*, 201*d*, and 201*e* have the same shapes as and are arranged symmetrically with loop elements 14*a*, 14*b*, 14*c*, 14*d*, and 14*e* and matching elements 101*a*, 101*b*, 101*c*, 101*d*, and 101*e* which are the same as used in the third embodiment (see FIG. 14, for example) with respect to the center axis 55.

The planar array antenna 170 according to this embodiment can provide a high gain by narrowing a beam (antenna radiation pattern) by increasing the number of loop elements arranged in the X-axis direction.

Figure 24:
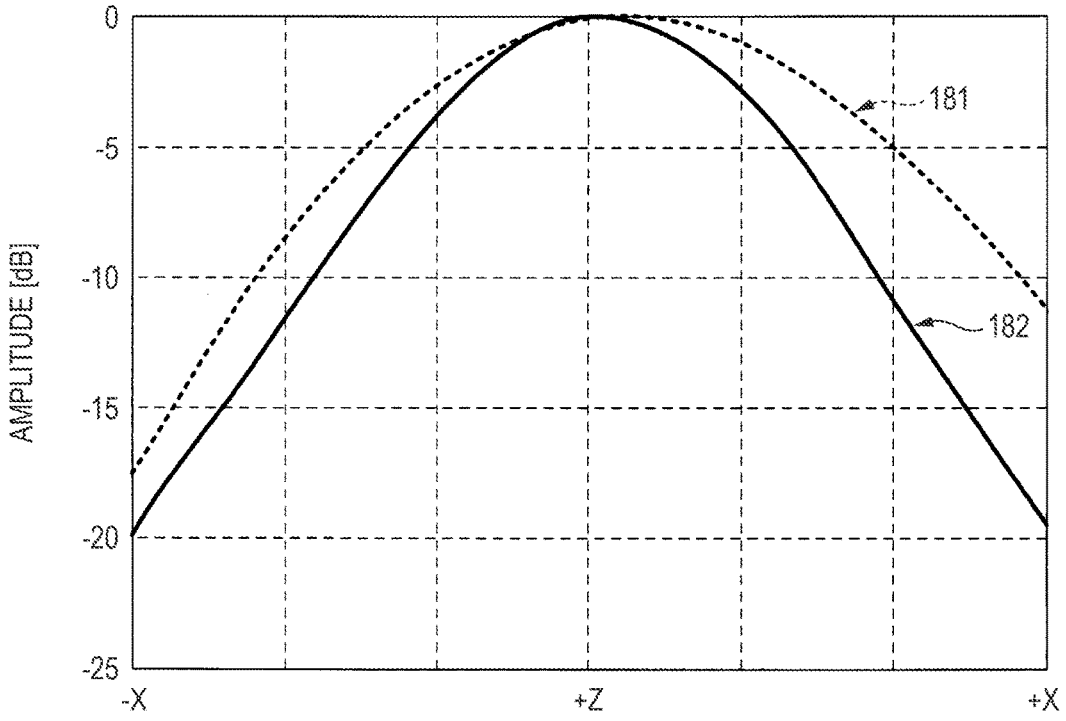
FIG. 24 is a graph showing radiation patterns of respective planar array antennas in the X-Z plane.

FIG. 24 is a graph showing radiation patterns of the respective planar array antennas 130 and 170 in the X-Z plane. As shown in the graph of FIG. 24, a radiation pattern 182 (beam) of the planar array antenna 170 shown in FIG. 23 is narrower than a radiation pattern 181 (beam) of the planar array antenna 130 shown in FIG. 14. In this embodiment, a superior antenna radiation characteristic can be obtained even in the case where the loop elements are arranged approximately symmetrically with respect to the center axis 55.

Although the various embodiments have been described above with reference to the drawings, it goes without saying that the disclosure is not limited to those examples. It is apparent that those skilled in the art would conceive changes or modifications of the various embodiments or combinations of the various embodiments within the confines of the claims. And such changes, modifications, or combinations should naturally be included in the technical scope of the disclosure.

The array antenna device according to the disclosure is not limited in configuration to planar array antennas each of which includes, for example, the strip conductor 12 extending in the +Y-axis or −Y-axis direction, the plural loop elements, and the microstrip antenna element (refer to the above-described embodiments and their modifications).

For example, the array antenna device according to the disclosure may be an array antenna in which plural planar array antennas each corresponding to the configuration according to any of the above-described embodiments and their modifications are arranged in the +X-axis or −X-axis direction. Such an array antenna device can suppress sidelobes with respect to a main beam and thereby realize even higher-gain radiation.

This disclosure is based on Japanese Patent Application No. 2012-207380 filed on Sep. 20, 2012, the disclosure of which is incorporated by reference in this disclosure.

INDUSTRIAL APPLICABILITY

This disclosure is useful when applied to array antennas which suppress sidelobes with respect to a main beam and thereby realize high-gain radiation.

DESCRIPTION OF SYMBOLS

10, 100, 130, 140, 150, 160: Planar array antenna
11: Dielectric substrate
12: Strip conductor
13: Conductor plate
14*a*-14*e*, 24, 34, 44, 141*a*-141*e*, 142-142*e*, 151*a*-151*e*, 161*a*-161*e*: Loop element
15: Input terminal

21, 21*a*: Opening
41: Connection element
51: Conductive connection portion
91: Perturbation element
101*a*-101*e*, 152*a*-152*e*, 162*a*-162*e*, 201*a*-201*e*: Matching element
131, 142: Microstrip antenna element

The invention claimed is:

1. An array antenna device comprising:
a substrate;
a linear strip conductor formed on one surface of the substrate;
plural loop elements formed on the one surface of the substrate; and
a conductor plate formed on the other surface of the substrate,
wherein each of the loop elements has a circumferential length that is approximately equal to one wavelength of a radiated radio wave, and is disposed at such a position as to be coupled with the strip conductor electromagnetically, and the loop elements are arranged alongside the strip conductor at distances that are equal to the one wavelength,
wherein a first portion of each of the loop elements which is closest to the linear strip conductor is spaced from the linear strip conductor by a prescribed distance with an air gap, and
wherein a cut part of each of the loop elements is arranged at a position other than both of the first portion of each of the loop elements and a second portion of each of the loop elements which is opposite to the first portion.

2. The array antenna device according to claim 1, wherein a part of at least one of the loop elements is cut away.

3. The array antenna device according to claim 1, wherein at least one of the loop elements has a perturbation element.

4. The array antenna device according to claim 1, further comprising:
conductive members disposed between the plural loop elements and the conductor plate,
wherein at least part of the loop elements are electrically connected to the conductor plate by the conductive members.

5. The array antenna device according to claim 1, further comprising:
loop members that are the same in number as the plural loop elements and are arranged symmetrically with the respective plural loop elements with respect to a center axis of the strip conductor.

6. The array antenna device according to claim 1, further comprising:
at least one matching element which corresponds to at least one of the loop elements and projects from the strip conductor.

7. The array antenna device according to claim 1, further comprising:
a strip antenna element disposed at an end of the strip conductor.

8. The array antenna device according to claim 1, wherein at least one of the plural loop elements is different from the other loop elements in at least one of conditions of:
an interval between the loop element and the strip conductor;
a width of the loop conductor;
whether the loop element is directly connected to the strip conductor;
whether part of the loop element is cut away; and
whether the loop element is electrically connected to the conductor plate.

9. An array antenna wherein plural array antenna devices each being the array antenna device according to claim 1 are arranged in a direction that is perpendicular to the strip conductor.

10. The array antenna device according to claim 1, wherein currents flowing through the plural loop elements are caused by only a current flowing through the linear strip conductor through electromagnetic coupling of the linear strip conductor and the plural loop elements.

* * * * *